US008966854B2

(12) United States Patent
Li

(10) Patent No.: US 8,966,854 B2
(45) Date of Patent: Mar. 3, 2015

(54) MODULAR CONSTRUCTION SYSTEM, ELEMENT AND ASSEMBLY METHOD THEREOF

(75) Inventor: Xian Li, Guangzhou (CN)

(73) Assignee: Xian Li, Guangzhou (CN)

( * ) Notice: Subject to any disclaimer, the term of this patent is extended or adjusted under 35 U.S.C. 154(b) by 23 days.

(21) Appl. No.: 13/702,037

(22) PCT Filed: Dec. 13, 2010

(86) PCT No.: PCT/CN2010/002031

§ 371 (c)(1),
(2), (4) Date: Sep. 5, 2013

(87) PCT Pub. No.: WO2012/034260

PCT Pub. Date: Mar. 22, 2012

(65) Prior Publication Data

US 2014/0020322 A1 Jan. 23, 2014

(30) Foreign Application Priority Data

Sep. 13, 2010 (CN) ..... 2010 1 0281301
Sep. 19, 2010 (WO) ..... PCT/CN2010/001441

(51) Int. Cl.

| | |
|---|---|
| ***E04C 1/00*** | (2006.01) |
| ***A47B 47/04*** | (2006.01) |
| ***A63H 33/08*** | (2006.01) |
| ***E04B 2/06*** | (2006.01) |
| ***E04F 11/038*** | (2006.01) |
| ***E04F 11/18*** | (2006.01) |

(52) U.S. Cl.

CPC . *E04C 1/00* (2013.01); *A47B 47/04* (2013.01); *A63H 33/084* (2013.01); *E04B 2/06* (2013.01); *E04F 11/038* (2013.01); *E04F 11/1817* (2013.01)

USPC ..... 52/588.1; 52/578; 52/585.1

(58) Field of Classification Search

CPC ..... E04B 2/06; E04B 2002/0247; E04B 2002/0254; E04B 2002/0245; E04C 1/00; A63H 33/084; A63H 33/105; A63H 33/04; A63H 33/082; A63H 33/086; A63H 33/08; A63H 33/044

USPC ..... 52/578, 585.1, 588.1, 608; 446/124, 446/125, 128

See application file for complete search history.

(56) References Cited

U.S. PATENT DOCUMENTS 2,278,327 A * 3/1942 Ludwig et al. ..... 446/124
3,410,021 A * 11/1968 Patterson ..... 446/78

(Continued)

*Primary Examiner* — Brian Glessner
*Assistant Examiner* — Adam Barlow
(74) *Attorney, Agent, or Firm* — Troutman Sanders LLP

(57) ABSTRACT

A modular construction system is provided, wherein the components (1, 2, 3, 4, 5, 6, 7, 9, 10, 11, 12, 13, 14, 15, 16, 17, 18) thereof includes Chinese character shaped components and a number of fish-bone shaped components. The fish-bone shaped components are formed according to the shapes of multiple Chinese characters. Except the "—" shaped pin components, the components (1, 2, 3, 4, 5, 6, 7, 8, 9, 10, 11, 12, 13, 14, 15, 16, 17, 18) are formed by assembling multiple identical cubes arranged according to the thickness of one cube and the shapes of the above Chinese characters. Since the concaves and convexes of the components are cube shaped, the components (1, 2, 3, 4, 5, 6, 7, 8, 9, 10, 11, 12, 13, 14, 15, 16, 17, 18) are locked to each other through the concaves and convexes between the components to assemble objects with stable structure composed of planes and standing column shaped structures. The components (1, 2, 3, 4, 5, 6, 7, 8, 9, 10, 11, 12, 13, 14, 15, 16, 17, 18) can be considered as universal parts after the planes and upright columns are dissembled. An assembling method of the modular construction system is also provided.

26 Claims, 24 Drawing Sheets

(56) References Cited

U.S. PATENT DOCUMENTS 3,449,857 A * 6/1969 Christopher ..... 446/124
3,819,188 A * 6/1974 Freedman ..... 273/160
3,822,569 A * 7/1974 Lautrup-Larsen ..... 446/85
4,381,619 A * 5/1983 Griffin ..... 446/125
4,699,602 A * 10/1987 Giorgi ..... 446/124
5,215,490 A * 6/1993 Szoradi ..... 446/115
5,405,135 A * 4/1995 Embro ..... 273/160
5,544,882 A * 8/1996 Sarkar ..... 273/157 R
5,924,906 A * 7/1999 Grafton ..... 446/121

* cited by examiner

MODULAR CONSTRUCTION SYSTEM, ELEMENT AND ASSEMBLY METHOD THEREOF

BACKGROUND

1. Technical Field

The present invention generally relates to a construction structure, more specifically, relates to a technology and a method of a modular construction structure, which can be applied in fields of architecture, furniture, and toy; meanwhile, the scope of the invention is not limited to the above fields, it is obvious to those skilled in the art that the invention can also be applied in other fields.

2. Description of Related Art

At present, most of modular systems are applied in the field of toy. The modular systems used in the toys are simply assembled and the structures of the objects assembled by the modular systems are unstable, resulting in the easy collapse thereof when being shaken. Additionally, the modular systems are not securely lockable and are not expandable. Nowadays, a few modular systems are designed to securely lockable, however, limited to the structures of these modular systems, the object assembled by the modular system has a single shape and is unstable, preventing the modular systems to be applied in other fields, such as the fields of architecture and furniture.

In the main technology of constructing a building, frame structures composed of steel reinforced concrete and bricks as well as walls constructed by concrete are used for dividing the space of the building. However, using the steel reinforced concrete, bricks, and walls to construct the building consumes a lot of resources and requires for heavy-duty machinery. Also, after the building is pulled down, a lot of construction waste will be produced. Furthermore, since the shape and the space of the building are constructed according to designed drawings, it is very difficult to alter the constructed building. Besides, the kind of building does not have movability and expandability.

Except the buildings built by steel reinforced concrete structure, most of the present modular buildings are like stacked containers. By designing a kind of connecting member or some locking portion, one of the containers is located above another container. However, this only divides and stacks the building simply, making the building look like a number of blocks stacked together from outside. Large mechanical machines are required in the constructing process of the building, and the shapes of the blocks of the building and the space of the building cannot be changed, which prevents the building from having expandability. At the same time, this kind of building is constructed by stacking a number of other units of same type, which greatly affects the movability of the building. Additionally, this kind of building cannot be disassembled into part, thus, the raw material of the building cannot be in common use with other buildings.

Another type of modular building uses steel bars and panels which can be assembled together and disassembled from each other to form the frames and the walls of the building. The steel bars and panels are connected to each other via various connecting members to form a house composed of frames, walls, and floors, for example, the complete-board house which is decoration-free and assembled rapidly described in the Chinese patent application CN200410028042.2, which is published on Jan. 18, 2006. This kind of modular building allows the space of the building to be expanded and the material to be recycled. Houses can be assembled rapidly by industrializedly producing the components in large number to satisfy housing demand from people. However, limited to the structures of these components, the shape and the space of the building assembled by these components are similar to the structure of a honeycomb, lacking of humanization and selection diversity in design. Also, due to limitations on universalnesses of these components, these components can be only used for constructing buildings of one or several particular shapes and of special functions.

It is known that light steel, especially cold-formed thin-walled light steel structure systems, are commonly used for constructing modular houses in European countries and America. The cold-formed thin-walled light steel structure system technology is mature in Australia and the principle thereof is similar to that of the technology of using modular panels to assemble the complete-board house which is decoration-free and is assembled rapidly as mentioned above, that is, using steel bars and panels which can be assembled together and disassembled from each other to form the frames and the walls of the building, and then connecting the steel bars and panels through connecting members to form the house composed of frames, walls, and floor. However, the main characteristic of using light steel to construct the building is that all the structural components of the building are pre-designed in the computer. These structural components required for forming the building such as frames of walls, floor beams, and roof trusses then are directly produced by the technology of CAD, by the control of light steel constructing and designing software, and by precise processing from intellectual processing apparatus. The manufacturing processes of these structural components are carried out by professional apparatus controlled by computer software. The other floor systems are constructed by using waterproof glass tile, waterproof coiled material, heat preservation material cotton, stringers, suspended fireproof gypsum board. The whole process is the similar to the industrialized production of automobile elements. The advantages of the modular building include small precision error of the structural components within half-millimeter which cannot be reached when being manufactured manually and mature producing processes of these structural components. The shortcomings of the modular building lie in: the manufacturing cost is high; the standard and programmed inner arrangement and supporting facility designs prevent people from handing the building freely because the building has been divided by the structure of the steel; additionally, galvanized steel is used in this kind of building for improving the corrosion resistance of the steel, which allows the main steel structure of the building to have the greatest corrosion resistance and to endure for 50 years; furthermore, a lot of new materials are required in construction of this kind of building in which the light steel is cooperated with heat preservation material and heat insulation material; besides, light new material is generally used for meeting the requirement of convenient construction. It is noted that the constructing process of this kind of building is carried out according to pre-designed constructing images, in this way, the so called "modular building" means assembling the pre-manufactured material like assembling building blocks, but not really means constructing the building using modular components. The structural component does not have universalness and lack of the expandability thereof in space and in function. Since the building is completely constructed according to pre-designed drawings, therefore, the construction of the building does not have the flexibility of the building blocks.

SUMMARY

The object of the present invention is to provide a modular construction system, structural principle of components and assembling method of the modular construction system. Specifically, the object of the invention is using a series of exchangeable components which can be assembled together in different ways to form various kinds of objects which have different functions and are composed of planes and standing column shaped structures.

A modular construction system, and components and assembling method thereof, including a series of components, the components includes "凵" shaped components, "一" shaped components, "冂" shaped component, "丶" shaped pin components, and a number of kinds of fish-bone shaped components; the fish-bone shaped components are formed according to the shapes of Chinese character "工", Chinese character "王", Chinese character "十", Chinese character "土", Chinese character "干"; except the "一" shaped pin components, the series of components are formed by combining a number of identical cubes which are arranged according to a thickness of one cube and according to the shapes of the above Chinese characters; convexes and concaves formed in each component is cube shaped, therefore, the series of components are capable of being locked to each other to allow the convexes to respectively engage with the concaves, thereby forming a number of stable objects composed of planes and standing column shaped structures; the series of components can be considered as universal elements of disassembled planes and standing columns; different kinds of components are assembled through the engagements between the convexes and concaves thereof; a hole is defined in each cube of the series of components to allow the "一" shaped pin component to pass therethrough and to be locked therein; by integrating locking functions of "丶" shaped pin components and the "凵" shaped components into the components themselves, the stable planes and standing column structures can be formed when locking the components together; the material of the component is of high tensile strength.

The essence of the present invention is locking a series of regularly shaped modular components to each other to assemble objects of different functions which are composed of planes and standing column shaped structures. The series of components have the same geometric structure principles, and each component is composed of a number of cubes arranged according to a thickness of one cube and the shapes of the above Chinese characters, wherein:

one kind of the fish-bone shaped components is composed of nineteen identical cubes arranged together according to the thickness of one cube in the order that the shape of the Chinese character "土" is located above and the shape of Chinese character "土" is located below (as component 1 shown in FIG. 1), and each cube of the fish-bone shaped component defines a hole into which the "一" shaped pin component is inserted (as component 1 and component 2 shown in FIG. 24);

one kind of the fish-bone shaped components is composed of nineteen identical cubes arranged together according to the thickness of one cube in the order that the shape of the Chinese character "工" is located above and the shape of Chinese character "土" is located below (as component 1 shown in FIG. 1), and each cube 20 of the fish-bone shaped component defines a hole 22 into which the "一" shaped pin component is inserted (as component 1 and component 2 shown in FIG. 24);

one kind of the fish-bone shaped components is composed of sixteen identical cubes arranged according to the thickness of one cube in the order that the shapes of the Chinese characters "土" are respectively located above and below (as component 3 shown in FIG. 1), and each cube of the component defines a hole into which the "一" shaped pin component is inserted (as component 3 and component 4 shown in FIG. 24);

one kind of the fish-bone shaped components is composed of eighteen identical cubes arranged according to the thickness of one cube in the order that the shape of the Chinese character "王" is located above and the shape of the Chinese character "工" is located below (as component 4 shown in FIG. 1), and each cube of the component defines a hole into which the "一" shaped pin component is inserted.

one kind of the fish-bone shaped components is composed of sixteen identical cubes arranged according to the thickness of one cube in the order that the shape of the Chinese character "土" is located above and the shape of the Chinese character "干" is located below (as component 5 shown in FIG. 1), and each cube of the component defines a hole into which the "一" shaped pin component is inserted;

one kind of the "凵" shaped component is composed of sixteen identical cubes arranged according to the thickness of one cube and according to the shape of the Chinese character "凵" (as component 6 shown FIG. 1);

one kind of the "一" shaped component is composed of five identical cubes arranged according to the thickness of one cube and according to the shape of the Chinese character "一" (as component 7 shown FIG. 1);

one kind of the "冂" shaped component is composed of nine identical cubes arranged according to the thickness of one cube and according to the shape of the Chinese character "冂" (as component 8 shown in FIG. 1);

one kind of the fish-bone shaped components is composed of fifteen identical cubes arranged according to the thickness of one cube in the order that the shapes of the Chinese characters "十" are respectively located above, in the middle, and below (as component 9 shown in FIG. 13), and each cube of the component defines a hole into which the "一" shaped pin component is inserted;

one kind of the fish-bone shaped components is composed of twenty-one identical cubes arranged according to the thickness of one cube in the order that the shapes of the Chinese characters "工" are respectively located above, in the middle, and located below (as component 10 shown in FIG. 13), and each cube of the component defines a hole into which the "一" shaped pin component is inserted;

the "十" shaped component is composed of seventeen identical cubes arranged according to the thickness of one cube and according to the shape of the Chinese character "十" (as component 11 shown in FIG. 13);

the "工" shaped component is composed of seven identical cubes arranged according to the thickness of one cube and according to the shape of the Chinese character "工" (as component 12 shown in FIG. 13);

one kind of the fish-bone shaped components is composed of seventeen cubes arranged according to the thickness of one cube in the order that the shape of the Chinese character "十" is located above and the shape of the Chinese character "工" is located below (as component 13 shown in FIG. 13), and each cube of the component defines a hole in which the "丶" shaped pin component is inserted;

one kind of the fish-hone shaped components is composed of fifteen identical cubes arranged according to the thickness of one cube in the order that the shape of the Chinese character "十" is located above and the shape of the Chinese character "門" is located below (as component 14 shown in FIG. 13); this kind of fish-bone shaped component can be considered as a component formed by cutting two middle cubes of another component (as component 13 shown in FIG. 13);

one kind of the "回" shaped component is composed of eight identical cubes arranged according to the thickness of one cube and according to the shape of the Chinese character "回" (as component 15 shown FIG. 13);

one kind of the fish-hone shaped components is composed of fourteen identical cubes arranged according to the thickness of one cube in the order that the shapes of the Chinese characters "工" are respectively located above and below (as component 16 shown in FIG. 13), and each cube of the component defines a hole into which the "一" shaped pin component is inserted (as component 7 shown FIG. 24);

one kind of the fish-hone shaped components is composed of fourteen identical cubes arranged according to the thickness of one cube in the order that the shapes of the Chinese characters "工" are respectively located above and below (as component 16 shown in FIG. 13), and each cube of the component defines a hole into which the "一" shaped pin component passing is inserted (as component 7 shown FIG. 24);

one kind of the fish-bone shaped component is composed of twelve identical cubes arranged according to the thickness of one cube in the order that the shape of the Chinese characters "凸" are respectively locating above, in the middle, and below (as component 18 shown in FIG. 13); the fish-bone shaped component can be considered as a component formed by cutting three middle cubes of another component (as component 9 shown in FIG. 13);

the "鼎" shaped component is composed of eleven cubes arranged according to a thickness of one cube and according to the shape of the Chinese character "鼎" (as component 3 shown FIG. 13);

one kind of the fish-bone shaped components is composed of thirty-three identical cubes arranged according to the thickness of one cube in the order that the shapes of the Chinese characters "工" are respectively located above, in the middle, and located below (as component 5 shown in FIG. 23), and each cube of the component defines a hole into which the "一" shaped pin component is inserted;

one kind of the fish-bone shaped components is composed of twenty-three identical cubes arranged according to the thickness of one cube in the order that the shape of the Chinese character "工" is located above and the shape of the Chinese character "土" is located below (as component 6 shown in FIG. 23); each cube of the component defines a hole into which the "一" shaped pin component is inserted;

one kind of the components is composed of seventeen identical cubes arranged according to the thickness of one cube and according to the shape of the Chinese character "冂" with one cube protruding from one lateral side thereof (as component 8 shown in FIG. 23);

one kind of the components is composed of twelve identical cubes arranged according to the thickness of one cube and according to the shape of the Chinese character "冂" with one cube protruding from one lateral side thereof (as component 8 shown in FIG. 23);

one kind of the fish-bone shaped components is composed of ten identical cubes arranged according to the thickness of one cube in the order that the shapes of the Chinese characters "工" are respectively located above and below (as component 8 shown in FIG. 23), and each cube defines a hole into which the "一" shaped pin component is inserted (as component 6 shown in FIG. 24);

the "一" shaped pin components include long pins and short pins, the short pins (as component 8 shown in FIG. 24) are used for being inserted into enclosed holes (as the holes shown in FIG. 24), and the long pins (as component 9 shown in FIG. 24) are used for being inserted into through holes (as the holes shown in FIG. 24).

The principle of the present invention is that: since convexes and the concaves formed in each component are cube shaped, therefore, the series of components are capable of being locked to each other by using different locking and assembling methods to allow the convexes to respectively engage with the concaves; according to one main locking and assembling method of the standing column, three pairs of above fish-bone shaped components are used, wherein two pairs of the components each of which has identical front and rear sides are locked to the other pair of the components each of which has identical left and right sides from two ends to form a standing column having a cross section composed of 3*3 cubes, the "回" shaped component is used for surrounding and locking the standing column, and the "一" shaped component is inserted into the holes defined in the locked components of the standing column to support and prevent the "凵" shaped component from sliding downwards, thereby finishing the locking and assembling of the components of the standing column; an extending portion of the standing column is assembled according to the same assembling method; and according to the principle, various standing columns of different shapes can be assembled by using different fish-bone shaped components.

According to the same principle, one main locking and assembling method of the plane is using two pairs of the above fish-bone shaped components, wherein one pair of the components each of which has identical front and rear sides is locked to the other pair of the components each of which has identical left and right sides to form a standing column having a cross section composed of 3*3 cubes, the "凵" shaped component is used for surrounding and locking the standing column, the standing column then is placed horizontally and considered to be an assembly of a cross beam; an extending portion of the cross beam is assembled according to the same assembling method, the "冂" shaped components is locked to an upper side of the cross beam, thereby finishing the manufacture of the single cross beam; a number of cross beams are assembled according to the same assembling method, and the cross beams are placed in parallel to form a suspended plane structure; according to the principle, when constructing a building, floors and stairs of the building can be assembled according to the assembling method.

According to the same principle, one main locking and assembling method of a wall is locking a pair of components each of which has identical front and rear sides to another pair of components each of which has identical upper and lower sides to form a standing column having a cross section composed of 3*3 cubes; the standing column is then placed horizontally and extended according to the same assembling method; after every three pairs of the components are locked together, concave spaces in shapes of the Chinese character "十" or "工" are defined in the upper/lower side or the front/rear side of the three pairs of locked components; three of the standing columns assembled according to the same method are placed horizontally as a top standing column, a middle standing column, and a lower standing column parallel to each other; a pair of fish-hone shaped components each of which has identical front and rear sides is locked to the concave spaces defined in the top standing column and the middle standing column placed in parallel; another pair of fish-bone components each of which has identical front and rear sides is locked to the concave spaces defined in the middle standing column and the lower standing column placed in parallel, thereby locking the top standing column, the middle standing column, and the lower standing column together; an extending portion of the wall can be assembled according to the same principle and the assembling method.

According to the same principle, one main locking and assembling method of the standing column is using two pairs of fish-bone components, wherein one pair of the fish-bone shaped components each of which has identical front and rear sides is locked to the other pair of the fish-bone shaped components to form the sanding column having a cross section composed of 3*3 cubes; the "—" shaped pin component is inserted into the holes defined in the locked components to lock the two pairs of fish-bone shaped components; an extending portion of the standing column is assembled by the same assembling method; according to the principle, various standing columns of different shapes are assembled by using different fish-bone shaped components.

According to the same principle, one main locking and assembling method of the standing column is using two pairs of fish-bone shaped components with holes, wherein the cubes located in each corner of one pair of the fish-bone shaped components each of which has identical upper and lower sides define enclosed holes perpendicular to the plane of the components, the cubes located in main part of the corresponding pair of fish-hone shaped components define through holes perpendicular to the planes of the corresponding components and parallel to the main part of the corresponding components; the cubes of the pair of fish-bone shaped components each of which has identical left and right sides, except the cubes located in the main part thereof, define through holes perpendicular to the planes of the corresponding components and parallel to the main part of the corresponding components; a "—" shaped short pin component is inserted into the holes defined in the main part of the pair of components each of which has identical left and right sides, thus, the short pin component is enclosed inside the components when the pair of components each of which has identical upper and lower sides is locked to the pair of components each of which has identical left and right sides; a "—" shaped long pin component is inserted into the holes defined in the pair of components each of which has identical left and right sides; through the assembling sequence, the short pin component can prevent the pair of components each of which has identical left and right sides from moving forth and back inside the components, and the long pin component can prevent the pair of components each of which has identical upper and lower sides from moving upwards and downwards; an extending portion of the standing column is assembled according to the same assembling method; concave spaces in shapes of Chinese character "十" or "工" are defined in the standing column when locking the extending portion of the standing column; a number of the standing columns are assembled according to the same method, the standing columns are placed in parallel to each other and adjacent to each other, a fish-bone shaped component containing the shape of the Chinese character "十" or "工" shaped is locked to the concave spaces to lock adjacent standing columns together; in the above kinds of fish-bone shaped component, the cubes of the fish-bone shaped component containing the shape of the Chinese character "十", except the cubes located in the main part of the component, define through holes parallel to the plane and the main part of the corresponding component; a "—" shaped long pin component is inserted into the adjacent and associating holes defined in the pair of components each of which has identical left and right sides to prevent associating components from moving downwards; and an extending portion of the plane can be assembled according to the same assembling method.

In specific working process of the present invention, a number of objects having same structures which are composed of planes and standing column shaped structures can be manufactured by assembling the modular components. The present invention can be applied in the fields of housing, public building and facility, furniture, and toy. Since the components of the present invention are connected together via locking structures formed thereon, thus, the components needs to be made of material of high tensile strength which can be selected from the group consisting of metal, wooden, synthetic wooden, and plastic.

Compared to the present technology from the aspect of simple assembly, when constructing buildings including houses, the series of building components of the present invention can be assembled together by using the characteristics themselves without using reinforced steel, concrete or other connecting members. Due to the simplification of the material forming the building, a number of constructing processes can be saved compared to the present technology, for example, the processes of soldering reinforced steel, pouring concrete, and drying concrete. Similarly, in the application of the present invention in the field of furniture, there is no requirement for any connecting members made of icon such as screws and nuts and no requirement for other material such as glue.

Compared to the present technology from the aspects of environmental protection and resource recycling, on one hand, when applying the present invention in the field of building, the components of the present invention can be locked together by the their own structures to form stable structures, therefore, walls, columns, beams, and frames can be built without using intermediate material such as reinforced steel, concrete, and sand and stone, which greatly reduces the reliance on of the building on the reinforced steel, concrete, and sand and stone; on the other hand, since the series of components can be assembled in different was to form different shapes, the flexible structures gives life to the components; as the assembly of different genes can form organs and organizations having different functions, several identical kinds of components can be arranged in different ways to form constructions, which can be houses (as shown in FIG. 12), columns of streetlights, telegraph poles, walls, roadblocks (as shown in FIG. 3), bus stations (as shown in FIG. 4), and yachts docks. Properties of the components allow the components to be recycled after the constructions are disassembled. Generally, furniture is often abandoned as a waste after playing its part fully or being overused and damaged. When applying the present invention in the field of furniture, the components can be re-assembled to form another piece of furniture according to requirements, such as the chair shown in FIG. 1, the table shown in FIG. 2, and the chairs manufactured by components with holes shown in FIG. 24. In this way, the second-hand objects can be recycled, which greatly reduces the environmental destruction from the wasted furniture and plays an important role in environmental protection and resources recycling.

Compared to the present technology from the aspect of universalness, in the application of the present invention in the field of architecture, the components of the present invention work as ordinary bricks and can be assembled to form buildings of different shapes without using intermediate connecting material, while the ordinary bricks are required to be used with reinforced steel and concrete to construct the buildings. The components of the present invention can be considered universal elements of these buildings which can be assembled in different ways to form objects composed of planes and columns, such as houses, pedestrian bridges, streetlights, walls, bus stations, and so on. When being applied in the field of furniture, the components can be used in different ways by taking advantage of their universalnesses, thereby allowing people to manufacture suitable furniture such as chairs, tables, bookcases, shoeboxes, and so on according to specific requirements.

Compared to the present technology from the aspect of spatial expandability, in the application of the present invention in the field of architecture, buildings constructed by the components of the present invention have good expandability. For example, to a house, people can transform the space of the house; to a pedestrian bridge, people can widen and lengthen the bridge or adding a canopy to the bridge easily. When being applied in the field of furniture, furniture formed by assembling the components of the present invention also has good expandability. For example, to a chair, people can change the size, the height and the structure of the chair according to requirements without using products manufactured according to industrialized standards in the past.

Compared to the present technology from the aspects of manufacturing and maintaining costs, in the application of the present invention in the field of architecture, the producing cost and time are greatly saved and the constructing mode of the buildings are changed, allowing the buildings to be constructed without reinforced steel, concrete, and sands to reduce cost of raw material. During the constructions of the buildings, a number of unnecessary processes can be omitted to breakthrough restrictions in time and space, heavy-duty machinery can also be omitted, and the construction can be carried out all day to assemble the components without making much noise, which breakthroughs restrictions on constructing time; meanwhile, assemblies of large components can be finished in factory departments and then transported to the constructing site to be further assembled, which breakthroughs restrictions on space. Additionally, the building can be easily maintained by changing damaged components. By the reduction in raw material, reduction in constructing processes, reductions in constructing facilities, easy maintenance, and open space and time, people can assemble suitable houses according to requirements by industrially producing the components of the present invention in large number.

Compared to the present technology from the aspect of anti-seismic performance, in the application of the present invention in the field of architecture, when building houses, the components of the present invention are locked together and are connected to each other end-to-end. In this way, the building can be considered as a knitted entirety, and the building can be prevented from being cracked due to the damage of some component and the stabilities of the other components can be prevented from being influenced by the damaged component. Also, stress of the walls and columns of the constructed building are evenly distributed to resolve strong shakes. Thus, the houses built according to the present invention can protect lives and safeties of property in earthquake.

DESCRIPTION OF DRAWINGS

Many aspects of the embodiments can be better understood with reference to the following drawings. The components in the drawings are not necessarily dawns to scale, the emphasis instead being placed upon clearly illustrating the principles of the embodiments. Moreover, in the drawings, like reference numerals designate corresponding parts throughout the several views.

DETAILED DESCRIPTION

Figure 1:
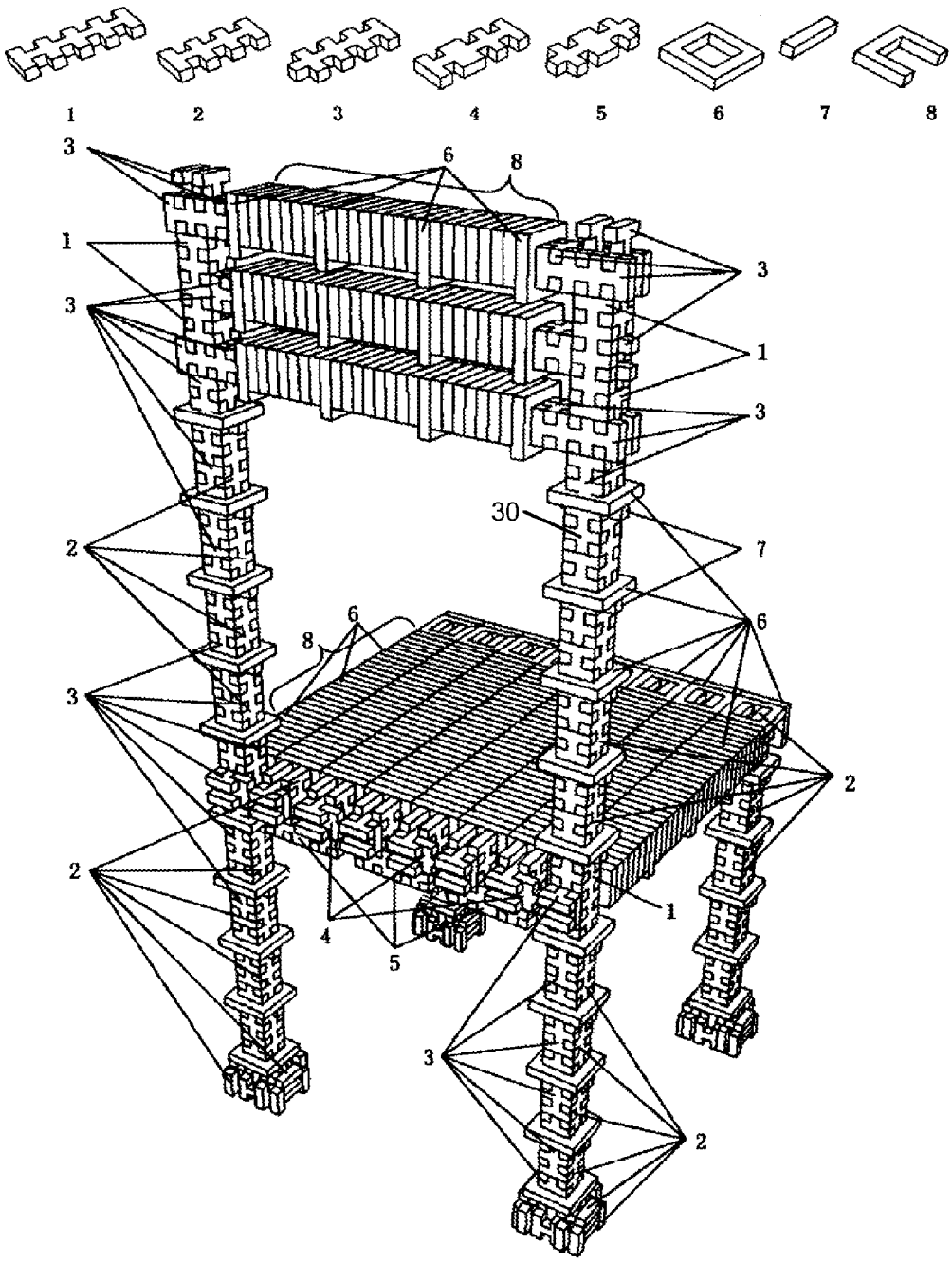
FIG. 1 is a schematic view of a chair, a piece of furniture manufactured by a modular construction system and components of the present invention.

The disclosure is illustrated by way of example and not by way of limitation in the figures of the accompanying drawings in which like references indicate similar elements. It should be noted that references to “an” or “one” embodiment is this disclosure are not necessarily to the same embodiment, and such references mean at least one.

In specific applications of the present invention, since the components with holes and the components without holes respectively have advantages and shortcomings, suitable components can be selected or the components with holes or without holes can be mixed and matched according to practical requirements. When manufacturing objects via components with holes, fish-bone shaped components can be simplified to more simple shapes in situations where "⊡" shaped components are not required, allowing planes and standing columns assembled by the components to have smoother lines and have outlines more approachable to that of practical objects in real life. However, since the process of assembling the components to form graphic objects is an one-way process, in the assembled planes, one component is locked to another component, like zipping up a zipper. When disassembling one part from the object, all the components in the zipper must be disassembled, reducing the function of simple assembly and simple disassembly of this kind of plane structure. Giving the advantages and shortcomings and the difficulty of assembly and disassembly of this kind of plane structure to overall consideration, it is desirable to use this kind of plane structure in field of furniture. In order to express the principle of the modular construction system sufficiently, in the embodiment, the components without holes are described as the main component, and the components are made of material of high tensile strength such as metal, wooden or synthetic wooden, and plastic. Since plastic not only has good chemical stability, corrosion resistance, electrical insulation, heat insulation, shock absorption capability, noise reduction effect, and good elasticity, but also can be easily pasted to other material such as metal, glass, and wooden, and can be manufactured easily, therefore, plastic is used as the material of the component in the embodiment. The component in the embodiment is made of plastic, with a bottom side of thereof being removed and the main body thereof being sallow and configured with reinforcing arms, which guarantees the light weight of the component and the easy assembly of the components. The specific assembling method in each embodiment can be referred to numerals shown in each drawing which is labeled along a line and used for representing a corresponding component shown in the drawing.

Referring to FIG. 1, which is a schematic view showing a chair manufactured by the modular construction system and the components thereof, in accordance with an embodiment of applying the present invention in the field of furniture. The modular components forming the chair include components 1, 2, 3, 4, 5, 6, 7, and 8. The eight kinds of components are locked to each other in some order to form standing columns and planes of the chair. The assembling method of columns of the leg and the back of the chair is: using three pairs of fish-bone shaped components, two pairs of the fish-bone shaped component each of which has identical front and rear sides are locked to the other pair of the fish-bone shaped components each of which has identical left and right sides to form a column 30 having a cross section composed of 3*3 cubes, after that, a "⊡" shaped component is used for surrounding and locking the column, a "—" shaped component is inserted into holes defined by the locked components of the column to support the "⊡" shaped component and further prevent the "⊡" shaped component from sliding downwards, thereby finishing the locking and assembling of the assembly. An extending portion of the standing column can be assembled according to the same method. When disassembling the standing column, the "—" shaped component is taken out from the standing column and the "⊡" shaped component is slided to loosen other fish-bone shaped components. It is noted that the embodiment provides one way of locking the components to form a stable structure of the standing column and the effect thereof. The thickness of each of the series of components is 1 millimeter, correspondingly, the chair has a total height of 100 millimeters and a seat height of 44 millimeters.

Figure 2:
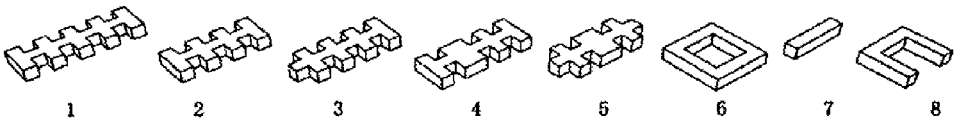
FIG. 2 is a schematic view of a table, a piece of furniture manufactured by the modular construction system and the components of the present invention.
Figure 2:
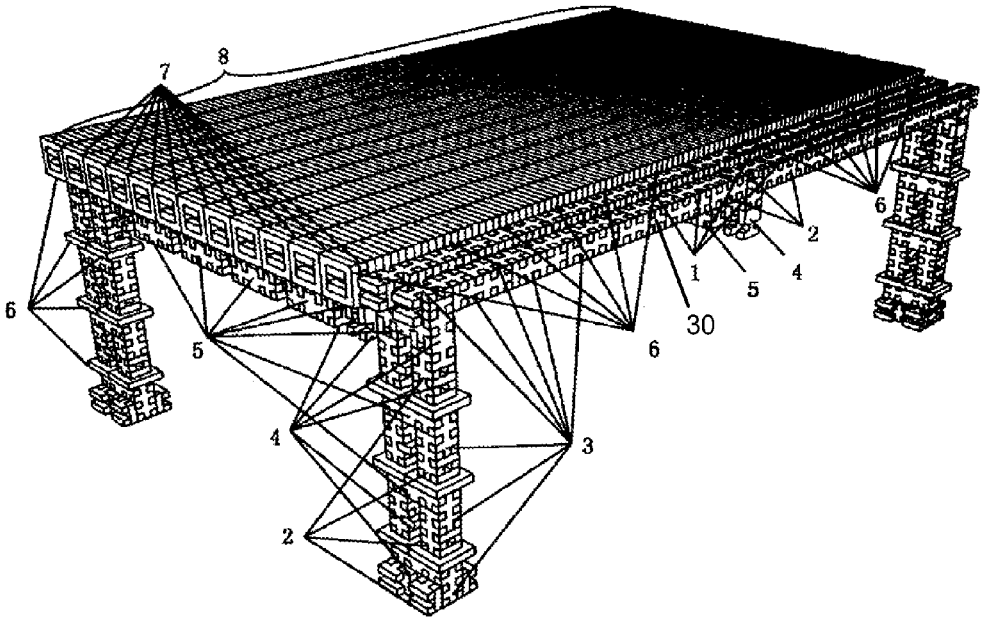

Referring to FIG. 2, which is a schematic view showing a table manufactured by the modular construction system and the components thereof, in accordance with an embodiment of applying the invention in the field of furniture. The components forming the table include components 1, 2, 3, 4, 5, 7, and 8. The eight kinds of components are locked to each other in some order to form standing columns and planes of the table. The assembling method of the legs of the table is modified and improved based on the structure of the standing column of the chair in the embodiment shown in FIG. 1, in which pairs of fish-bone shaped components 4 are used for locking two standing columns to form a standing columns having more stable structure and increased bearing capacity. The assembling method of a top surface of the table is: using two pairs of fish-bone shaped components, one pair of the fish-bone shaped components each of which has identical front and rear sides is locked to the other pair of the fish-bone shaped component each of which has identical left and right sides to form a standing column 30 having a cross section composed of 3*3 cubes; after that, the "⊡" shaped component is used for surrounding and locking the standing column; the column than is placed horizontally and is considered as an assembly of a cross beam of the table; an extending portion of the cross beam is assembled in the same way; a "⊓" shaped component is then locked onto the upper side of the cross beam, thereby finishing the assembly of the single cross beam. A number of the cross beams are assembled in the same way. The cross beams are placed parallel to each other form a suspended panel structure. Under a middle portion of the table, components 4 and 5 are used for forming a locking portion by using locking position preserved in the cross beam of a top surface of the table. The structure of the locking portion is the same as the structures of two ends of the top surface of the table, and the locking portion is perpendicular and locked to the adjacent cross beam of the top surface of the table. In the embodiment, the leg of the table can be reinforced according to requirements and the top surface of the table can be lengthened and widened according to requirements, which extends the application of the present invention. The thickness of each component of the series of components is one millimeter, correspondingly, the table has a height of 39 millimeters, a width of 70 millimeters, and a length of 109 millimeters.

Figure 3:
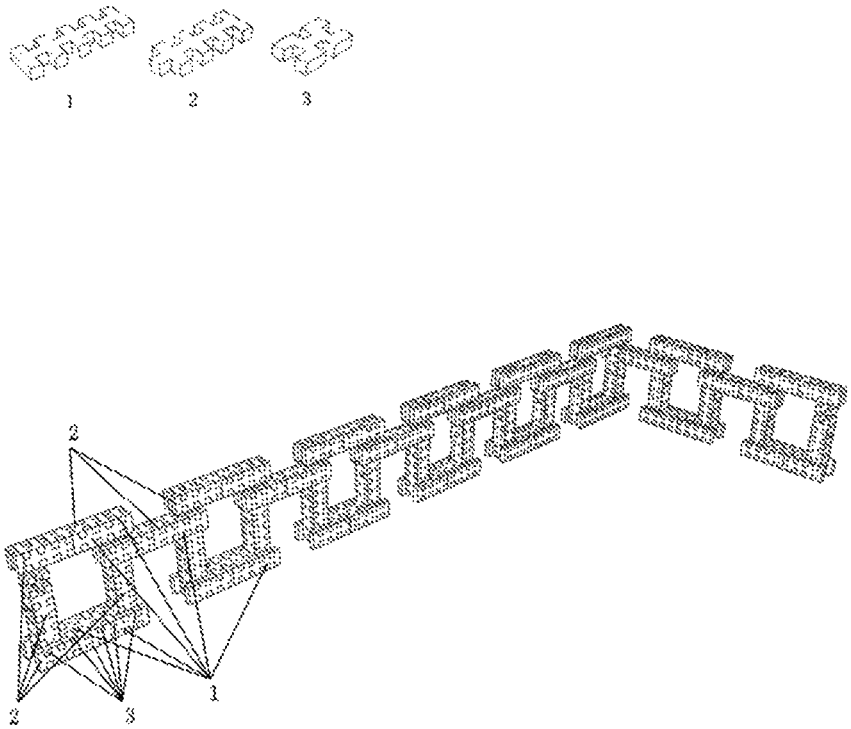
FIG. 3 is a schematic view of a highway roadblock manufactured by the modular construction system and the components of the present invention.

Referring to FIG. 3, which is a schematic view showing a roadblock manufactured by the modular construction system and the components thereof, in accordance with an embodiment of applying the present invention in the field of public facility. The modular components forming the roadblock include components 1, 2, and 3. The three kinds of components are locked to each other in some order to form the roadblock. Through the embodiment, the roadblock can be manufactured by simply assembling the three kinds of components 1, 2, and 3, which sufficiently shows the practicality and convenient assembly of the series of components. The thickness of each component of the series of components is 5 millimeters, correspondingly, the roadblock has a height of 90 millimeters and a total length of 925 millimeters.

Figure 4:
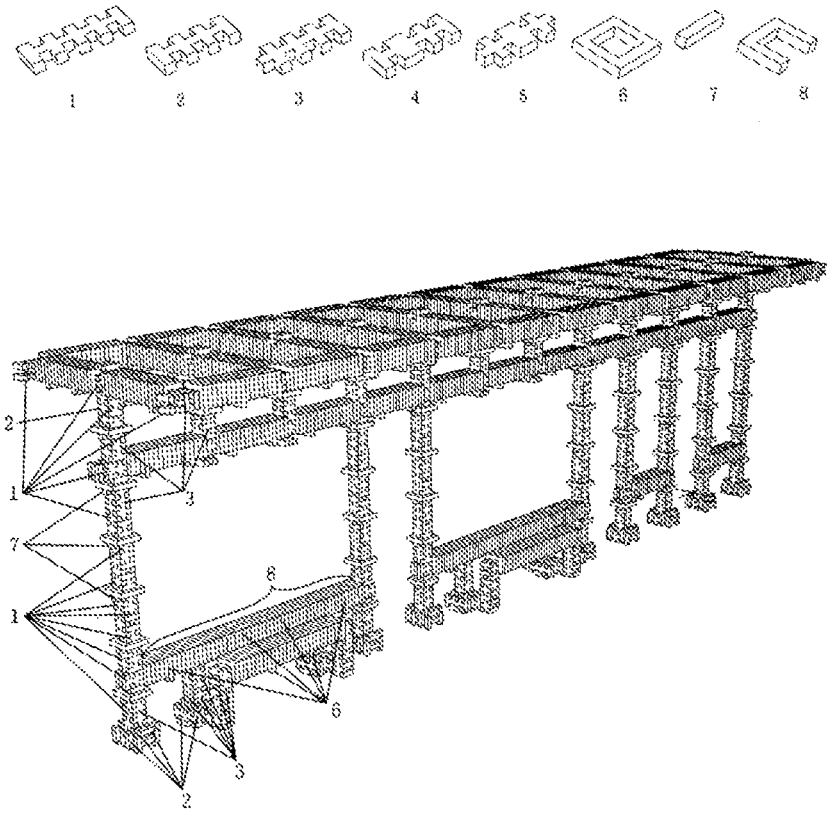
FIG. 4 is a schematic view of a bus station built by the modular construction system and the components of the present invention.

Referring to FIG. 4, which is a schematic view showing a frame of a bus station manufactured by the modular construction system and the components thereof, in accordance with an embodiment of applying the present invention in the field of public facility. The modular components forming the bus station include component 1, 2, 3, 4, 5, 6, 7, and 8. The eight kinds of components are locked to each other in some order to form columns and cross beams of the bus station. The assemblies of the columns and cross beams of the bus station are the similar to the assemblies of the columns and cross beams in the embodiments shown in FIGS. 1 and 2. In practical application, component forming a base of the bus station are fixingly embedded underground to prevent the bus station from swaying sideways. From the embodiments, it can be concluded that using the eight kinds of components having the same structures as the structures of the eight kinds of components of the chair shown in FIG. 1 and the table shown in FIG. 2, the components can be applied in the field of furniture when being manufactured in small sizes and applied in the field of public facility or architecture when being manufactured in large sizes. In the embodiment, the thickness of each component of the series of components is 5 millimeters, correspondingly, the bus station has a height of 360 millimeters, a width of 235 millimeters, and a length of 1125 millimeters.

Figure 5:
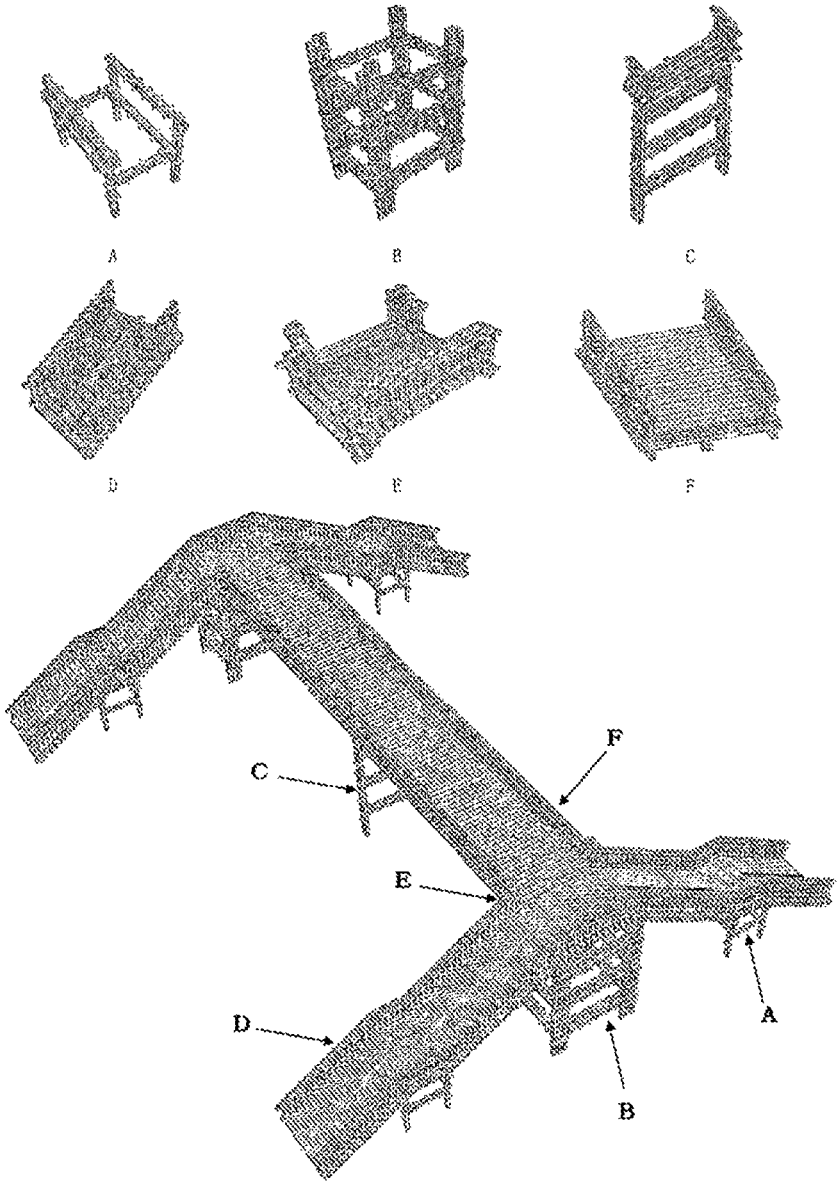
FIG. 5 is a schematic view of a pedestrian bridge built by the modular construction system and the components thereof of the present invention.
Figure 6:
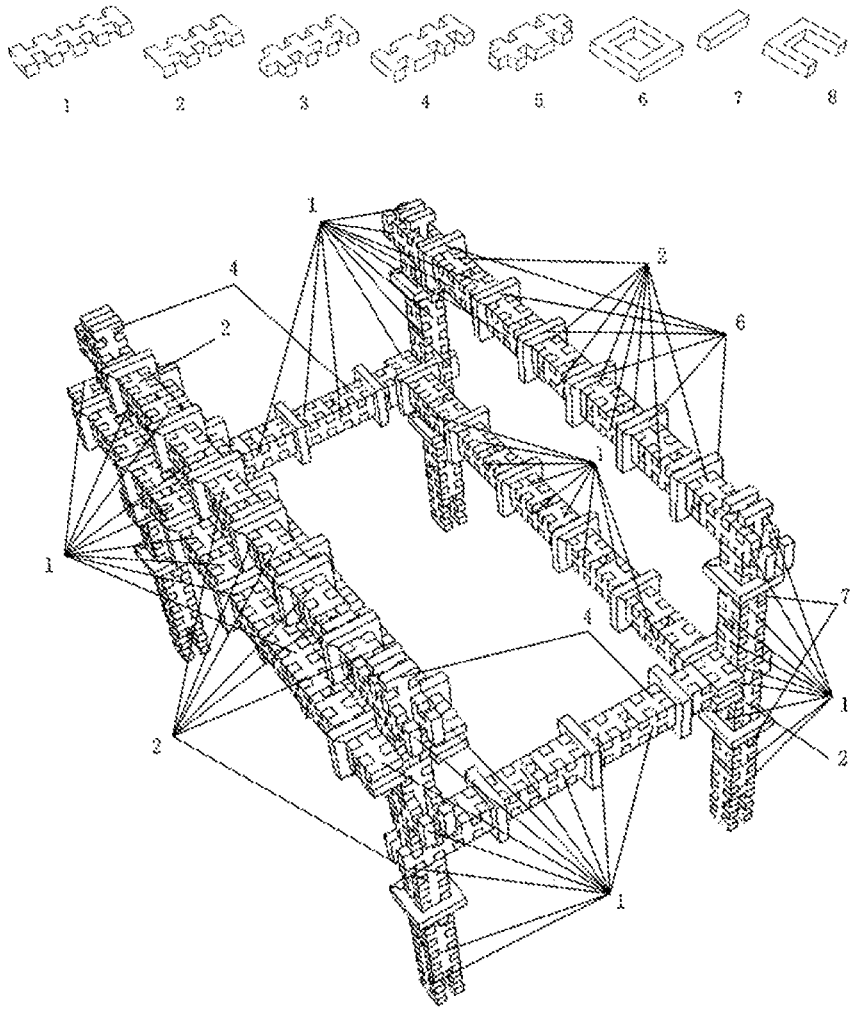
FIG. 6 is a schematic view of a portion A, supporting columns of a stair of the pedestrian bridge shown in FIG. 5.
Figure 7:
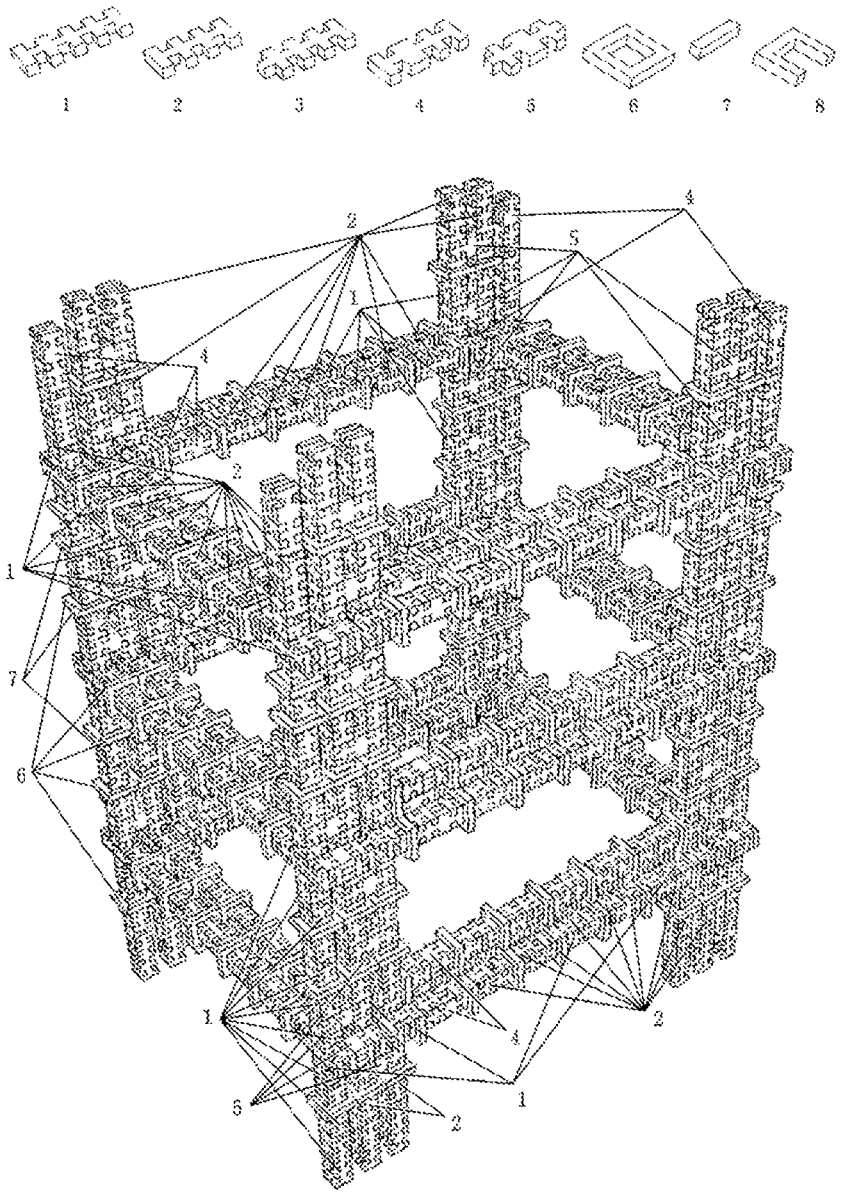
FIG. 7 is a schematic view of a portion B, supporting columns of a main body of the pedestrian bridge shown in FIG. 5.
Figure 8:
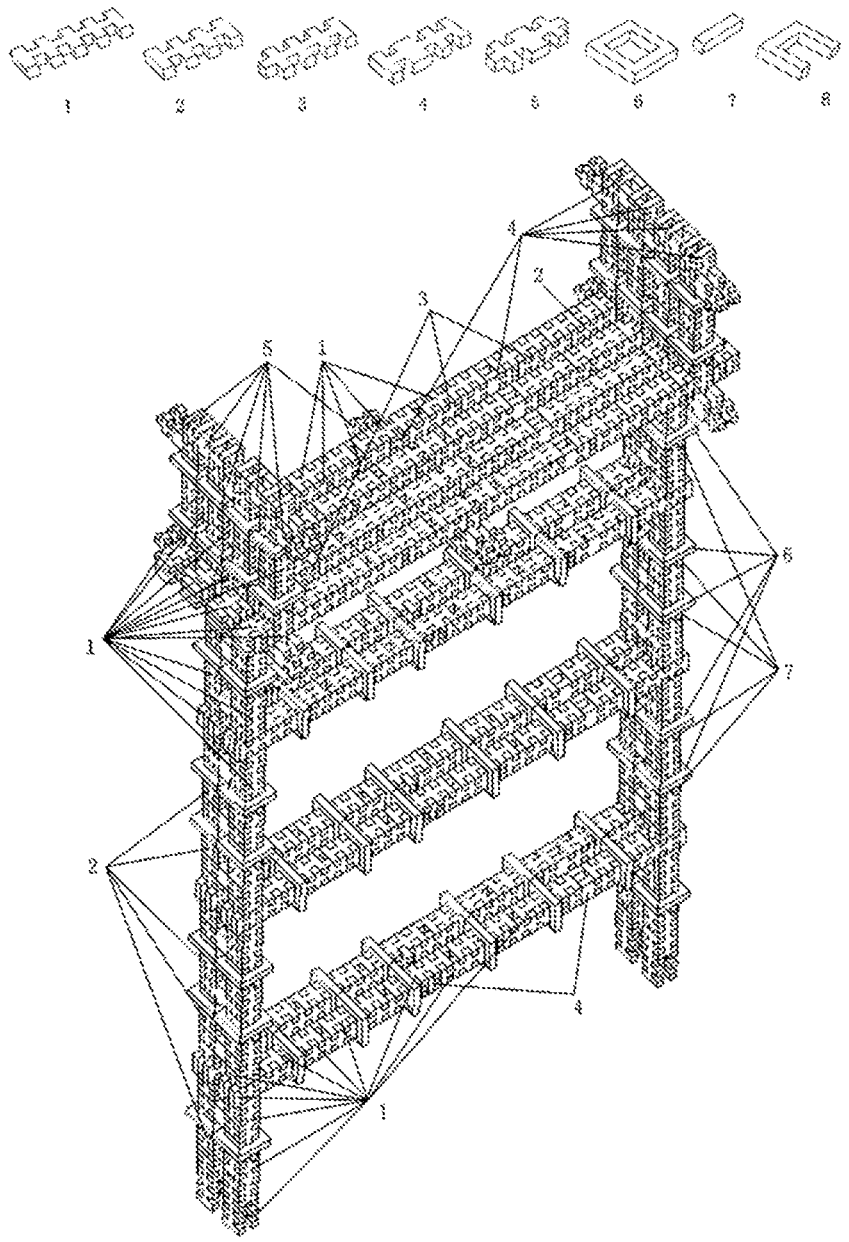
FIG. 8 is a schematic view of a portion C, supporting columns of a middle portion of the pedestrian bridge shown in FIG. 5.
Figure 10:
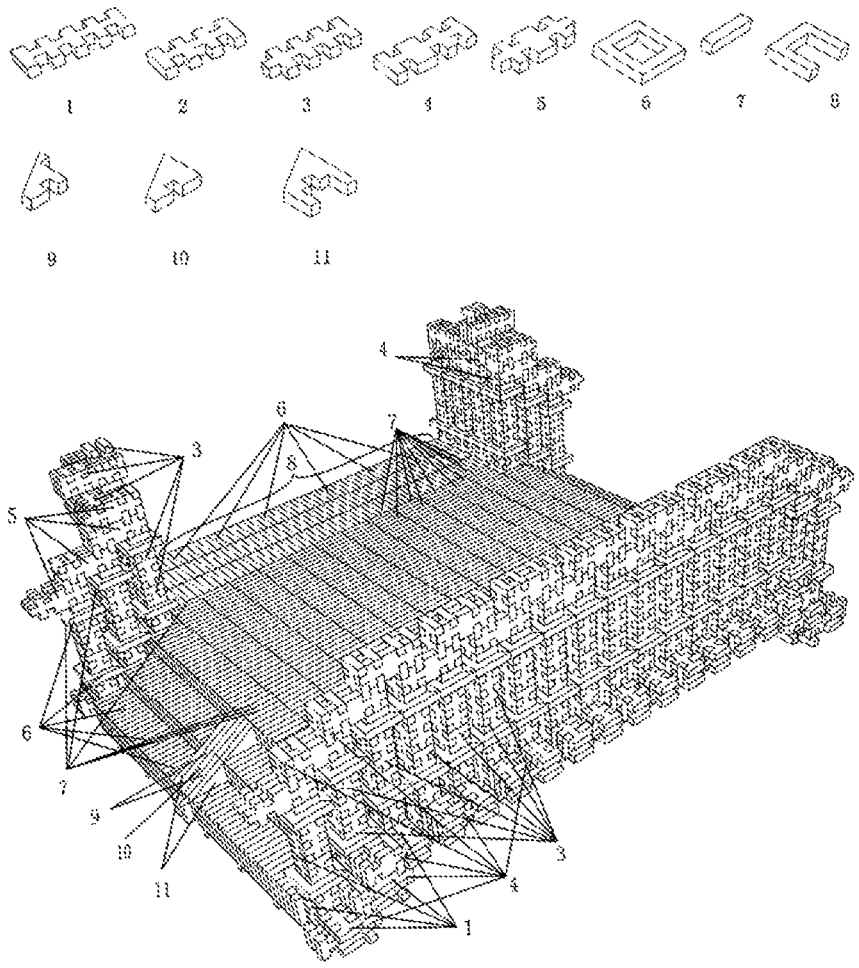
FIG. 10 is a schematic view of a portion E, a transshipping platform between the stairs of the pedestrian bridge shown in FIG. 5.
Figure 11:
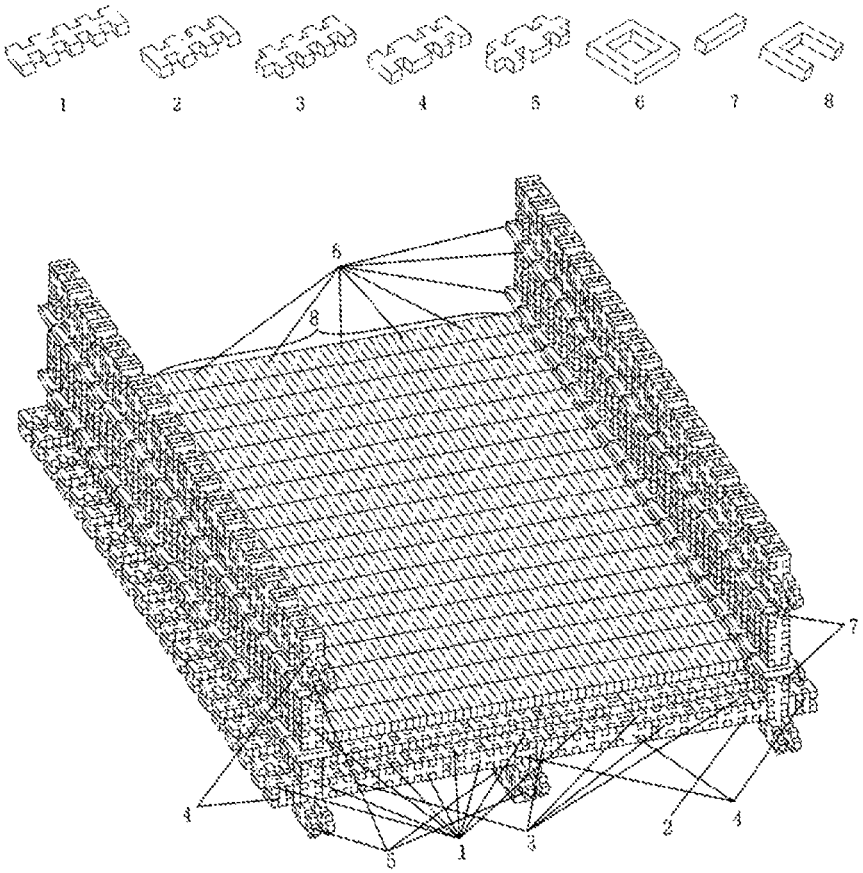
FIG. 11 is a schematic view of a portion F, a bridge deck of the pedestrian bridge shown in FIG. 5.

Referring to FIG. 5, which is a schematic view showing a pedestrian bridge manufactured by the modular construction system and the components thereof, in accordance with an embodiment of applying the present invention in the field of civic building. In the embodiment, main parts of the pedestrian bridge include parts A, B, C, D, E, and Components forming the six parts of are the same as the components 1, 2, 3, 4, 5, 6, 7, and 8 used in FIG. 1, FIG. 2, and FIG. 4. The specific structure of each above part can be referred to supporting columns of a stair of the pedestrian bridge shown in FIG. 6, supporting columns of a main body of the pedestrian bridge shown in FIG. 7, supporting columns of a middle portion of the pedestrian bridge shown in FIG. 8, the stair of the pedestrian bridge shown in FIG. 9, a transshipping platform between the stairs of the pedestrian bridge shown in FIG. 10, and a top surface of the pedestrian bridge shown in FIG. 11. The embodiment further shows universalness and practicality of the series of components. The thickness of each component of the series of components is 5 millimeters, correspondingly, the pedestrian bridge shown in FIG. 5 has a top surface of 535 millimeters tall, stairs of 255 millimeters wide, guardrails of 105 millimeters tall, and a bridge body of 2350 millimeters long.

Figure 9:
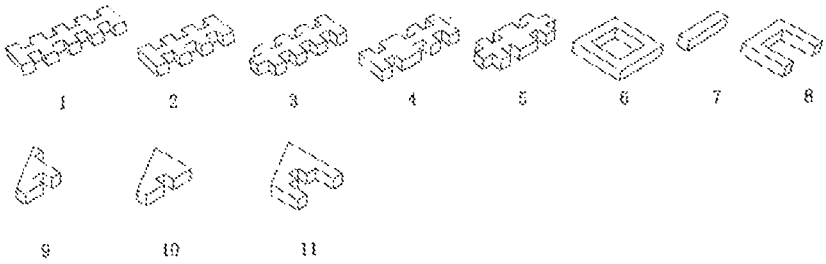
FIG. 9 is a schematic view of a portion D, the stair of the pedestrian bridge shown in FIG. 5.
Figure 9:
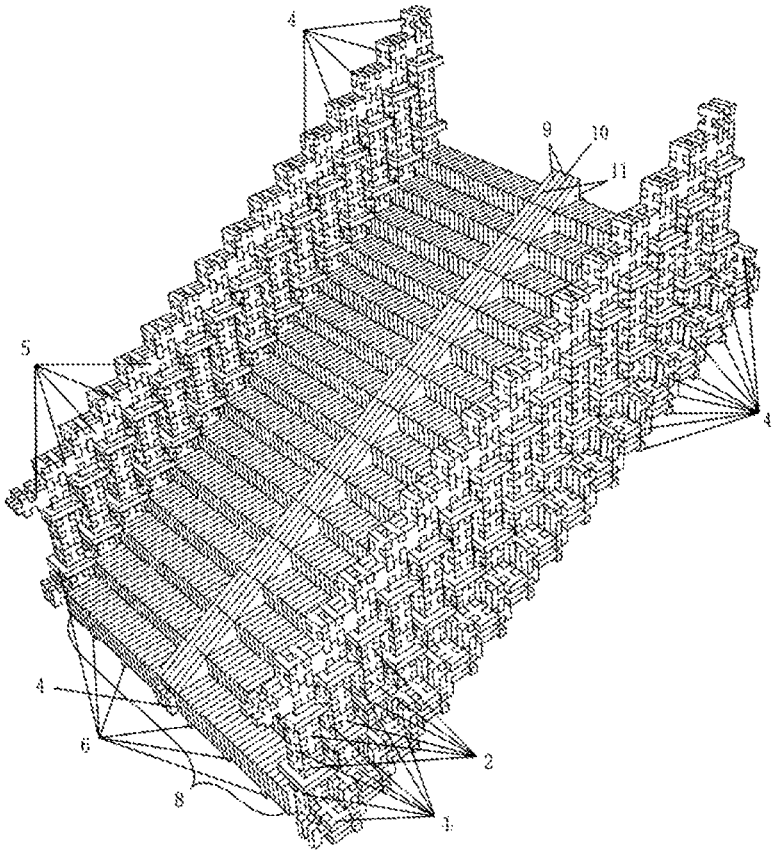

Referring to FIG. 9, which is a schematic view showing a part of the stair of the pedestrian bridge shown in FIG. 5. Compared to other parts of the pedestrian bridge, another three kinds of components are used in the stair for forming inclined surfaces. These three kinds of components 9, 10, and 11 are geometric objects specifically designed for forming the inclined surfaces which allows bicycles to pass the pedestrian bridge. When being assembled, the concave defined in component 11 presses the "—" shaped component 7 thereunder, and components 9 and 10 are locked onto the "—" shaped component 7 to prevent the "—" shaped component 7 from being slidable. From the schematic view of the structures of the stairs of the pedestrian bridge, it can be concluded the stair with inclined surfaces can be disassembled to planes and columns by the components 1, 2, 3, 4, 5, 6, 7, and 8, showing that the principle of the present invention is locking a series of modular components of different shape together to form the planes and columns of different kinds of objects of different functions.

Figure 12:
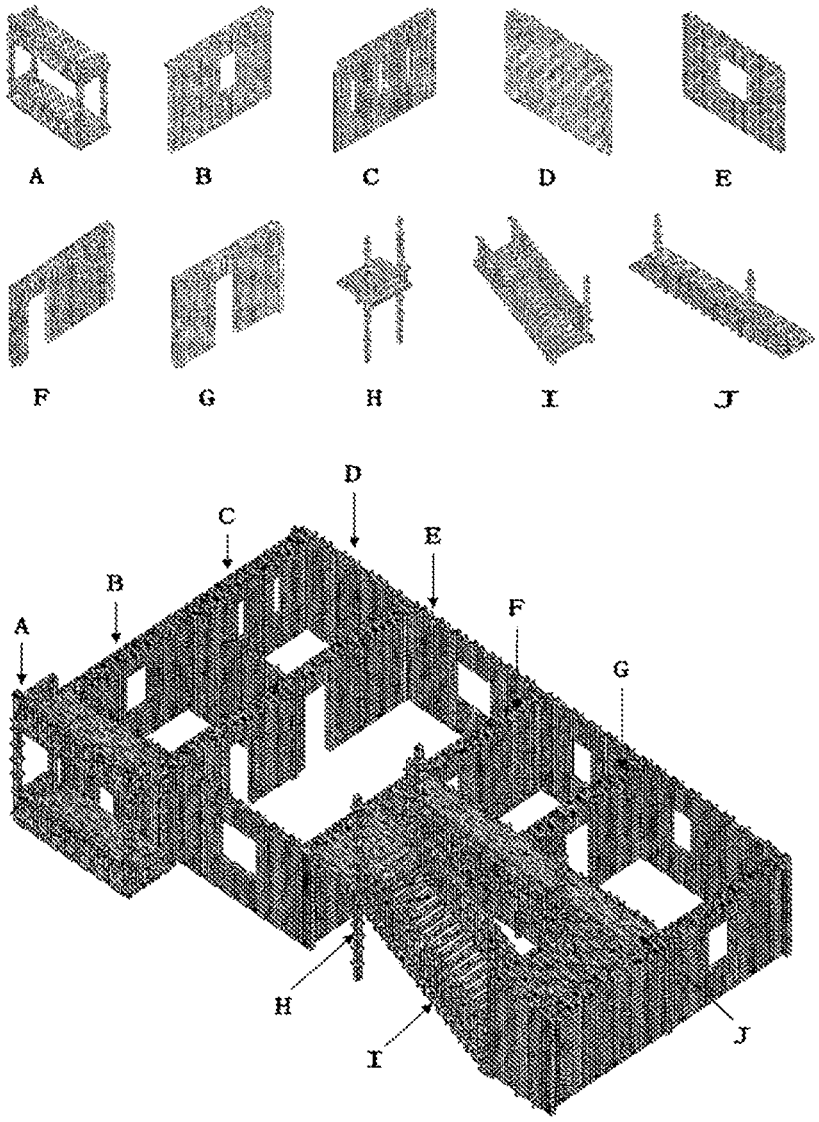
FIG. 12 is a schematic view of house unit built by the modular construction system and the components thereof of the invention.
Figure 16:
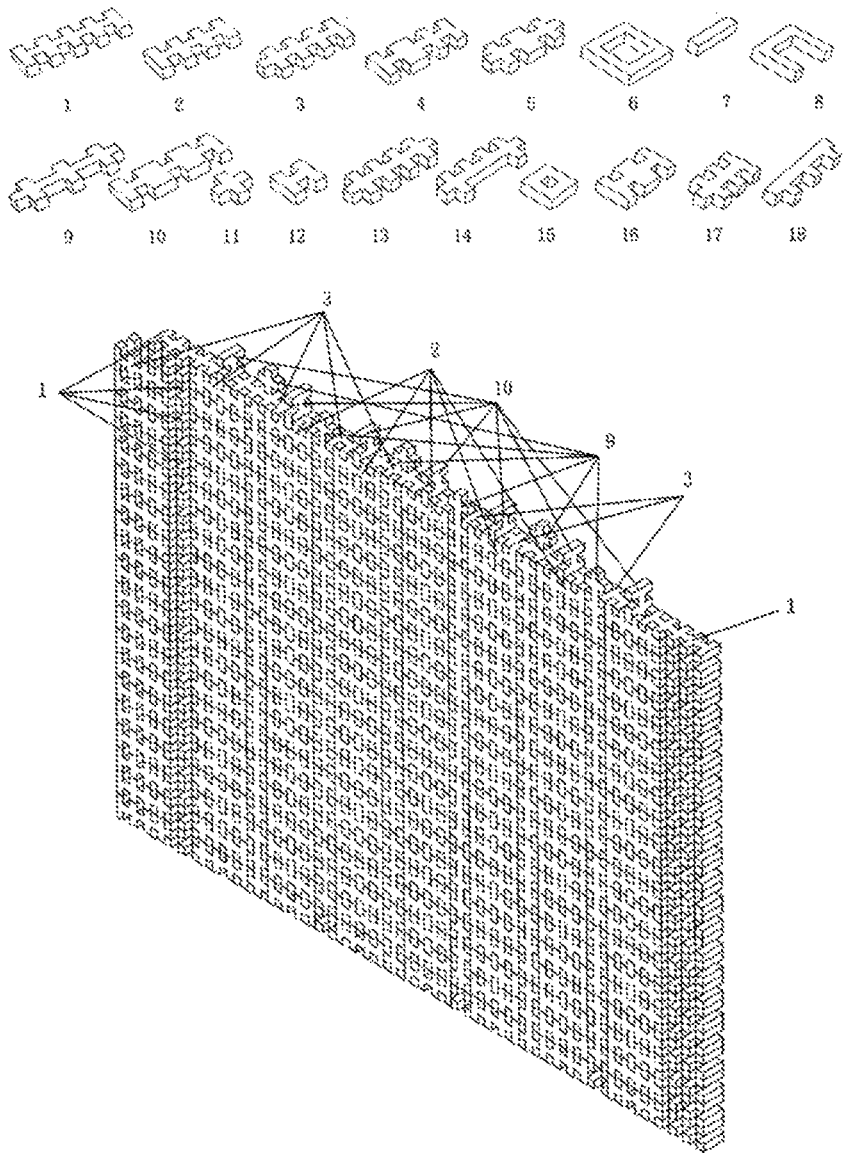
FIG. 16 is a schematic view of a portion D, an enclosed wall of the house shown in FIG. 12.
Figure 17:
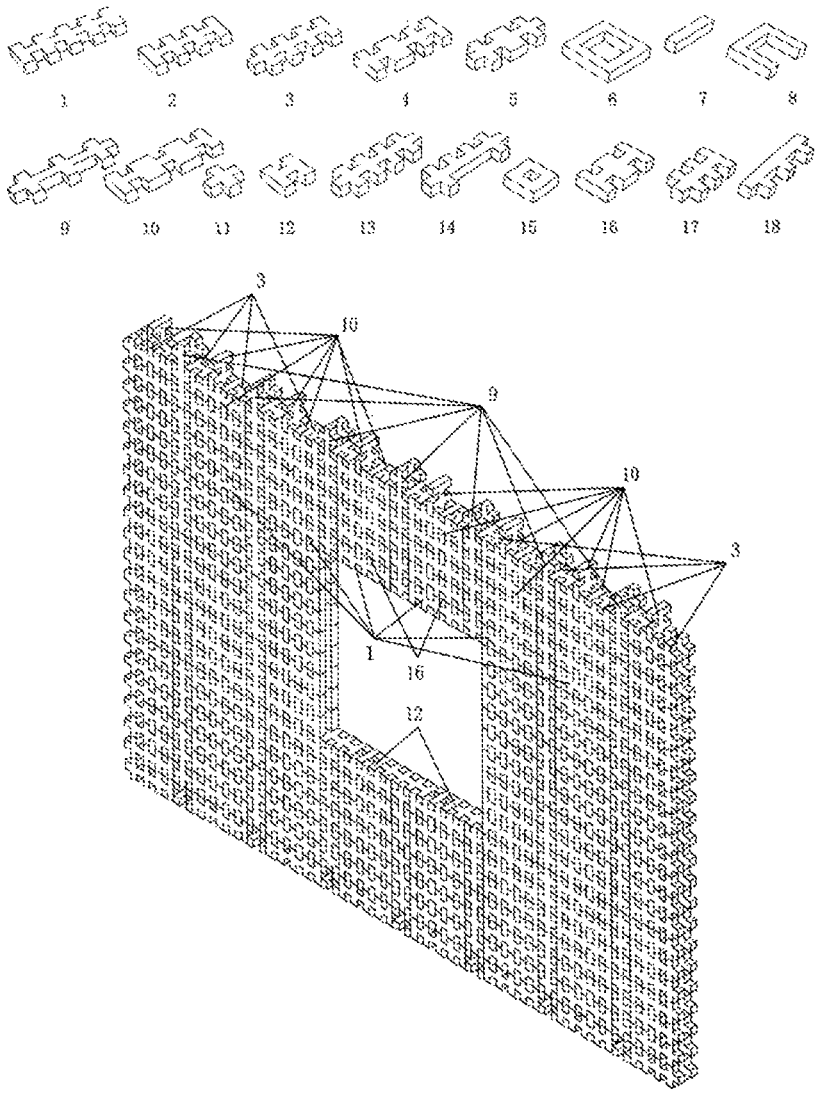
FIG. 17 is a schematic view of a portion E, another wall with a large window of the house shown in FIG. 12.
Figure 18:
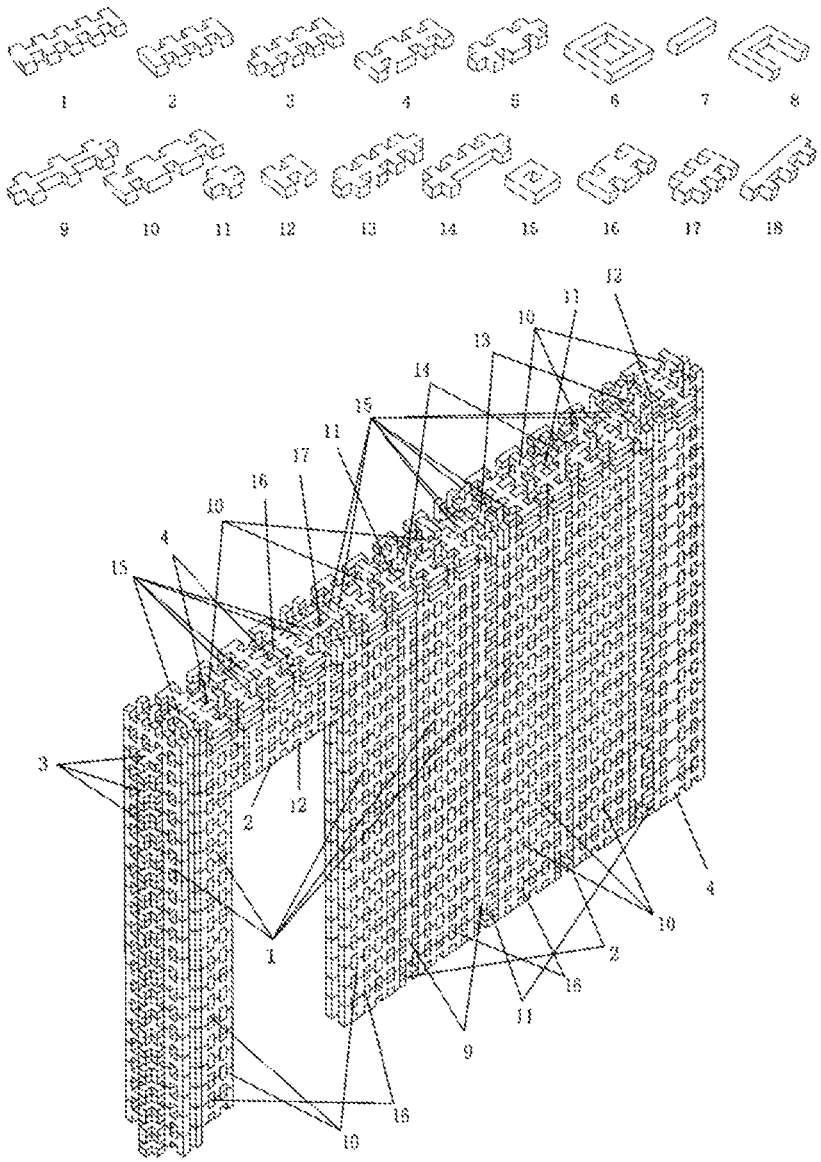
FIG. 18 is a schematic view of a portion F, a wall with a door of the house shown in FIG. 12.
Figure 19:
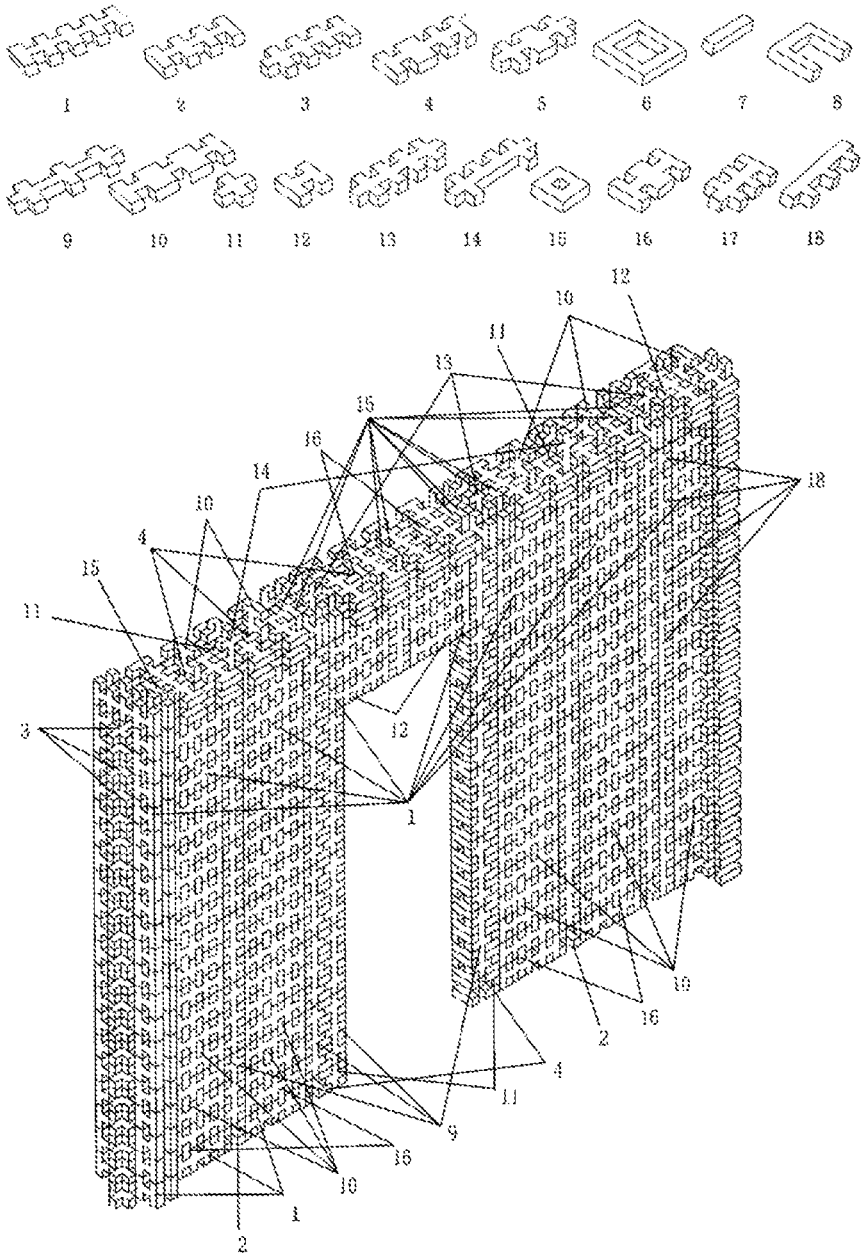
FIG. 19 is a schematic view of a portion G, another wall with a door of the house shown in FIG. 12.
Figure 20:
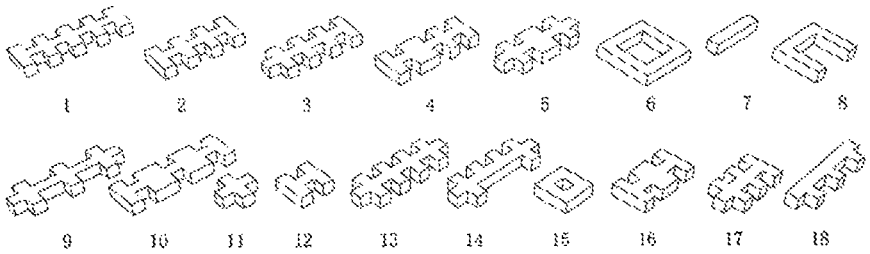
FIG. 20 is a schematic view of a portion H, a transshipping plate of a stair of the house shown in FIG. 12.
Figure 20:
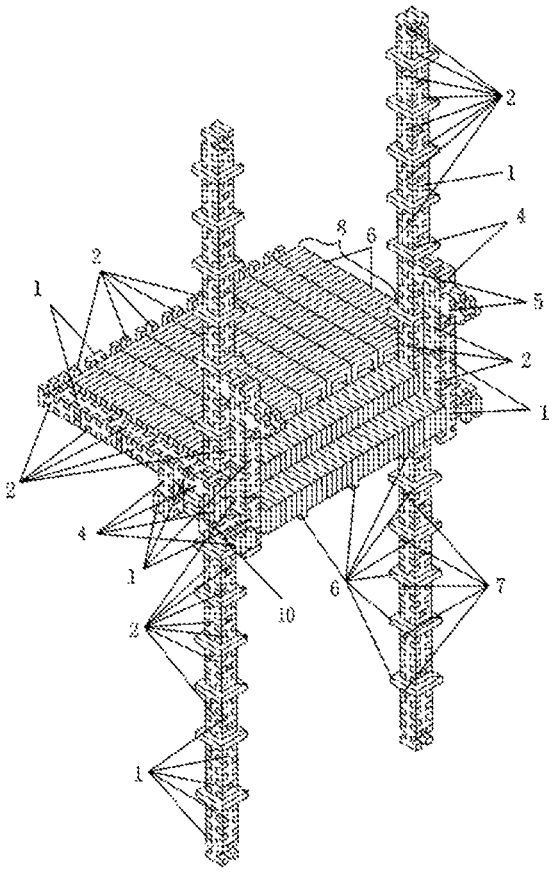
Figure 21:
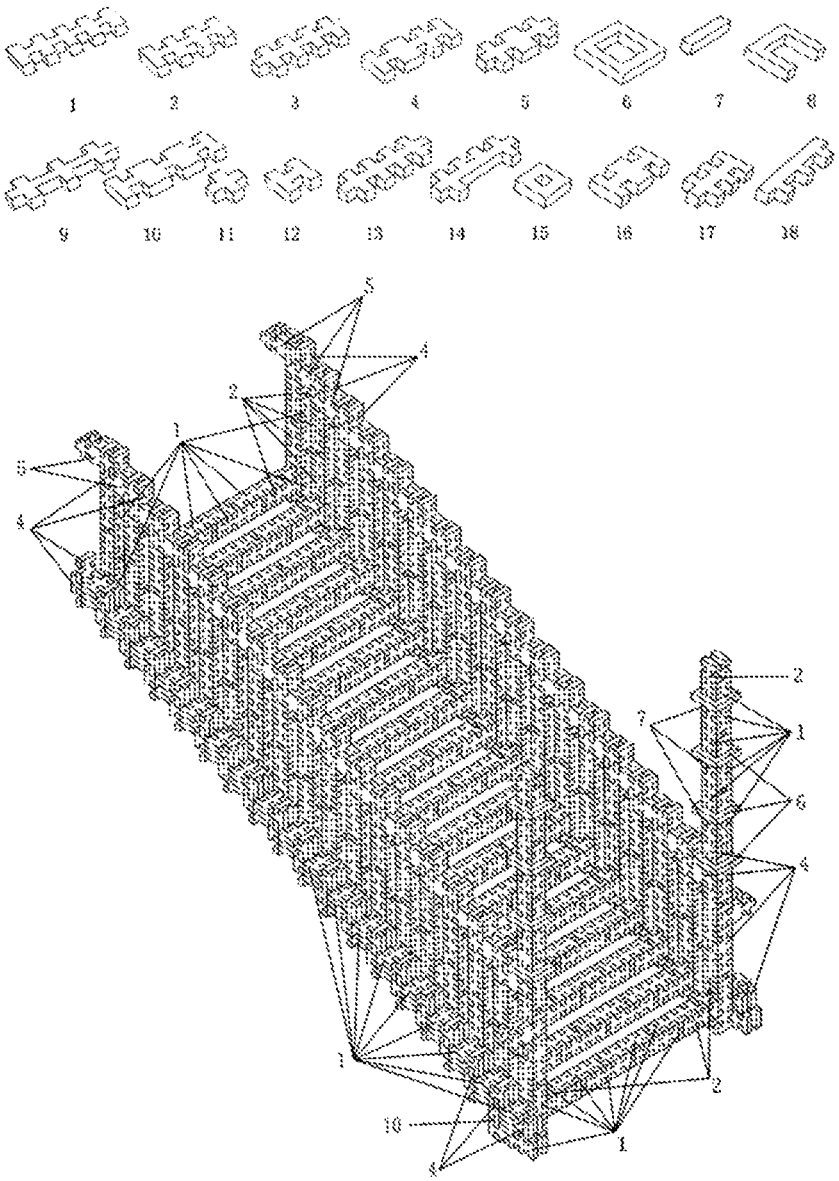
FIG. 21 is a schematic view of a portion I, the stair of the house shown in FIG. 12.
Figure 22:
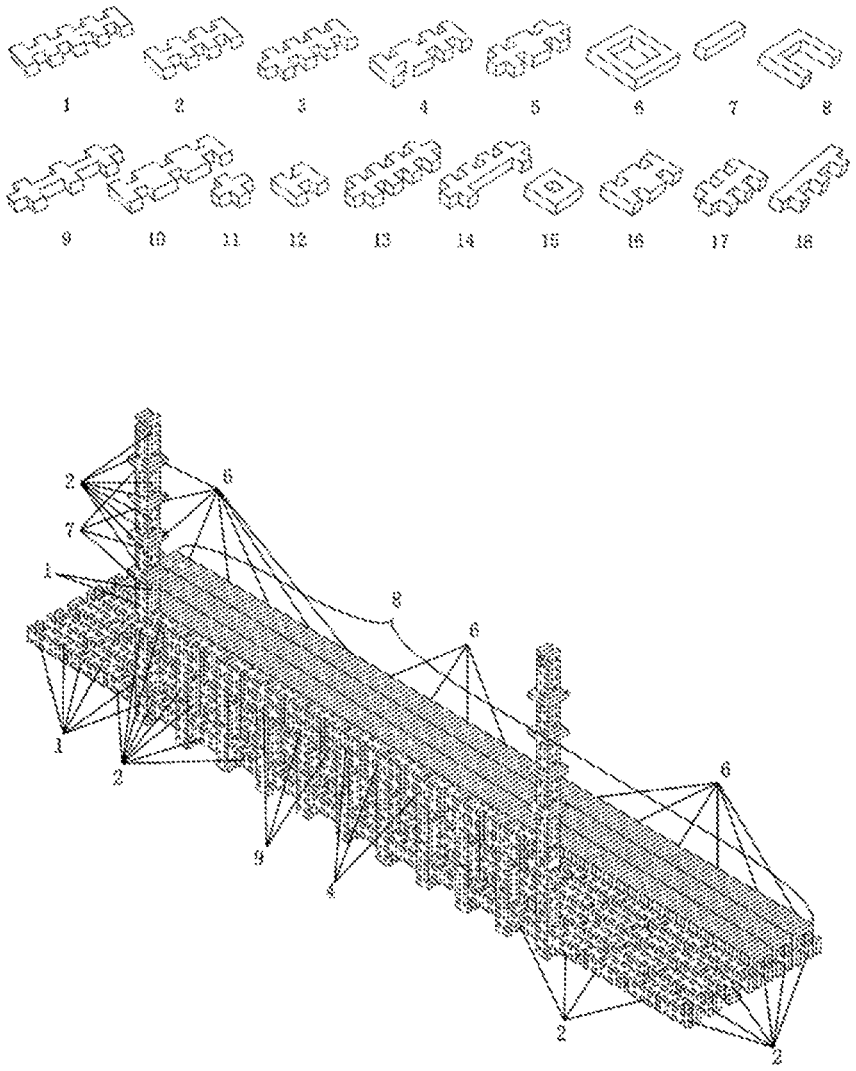
FIG. 22 is a schematic view of a portion J, an aisle of the stair of the house shown in FIG. 12.

Referring to FIG. 12, which is a schematic view showing the structure of a single floor of a house built by the modular construction system and the components thereof, in accordance with an embodiment of applying the present invention in the field of architecture. The main structures of the house include the following 10 parts: A, B, C, D, F, F, G, H, I, and J. In the embodiment, the first floor of the built house can be considered as an unit. Since four walls and columns of a balcony and a stair of the house unit are provided with preserved components for being locked to corresponding portions of an upper storey, therefore, when building the second floor, the third floor, the fourth floor, and higher floors, it only requires repeatedly manufacturing the housing unit having the same structure as that of the first floor. The structure of each part of the housing unit can be referred to the balcony shown in FIG. 13, a wall having a large window shown in FIG. 14, a complete wall shown in FIG. 16, another wall with a large window shown in FIG. 17, a wall with a door shown in FIG. 18, another wall with a door shown in FIG. 19, a transshipping platform of the stair shown in FIG. 20, a stair shown in FIG. 21, and an aisle of the stair shown FIG. 22. The thickness of each component in the embodiment is 5 millimeters, correspondingly, the single-floor house shown in FIG. 12 has a height of 300 millimeters and each wall of the house has a thickness of 15 millimeters.

Figure 13:
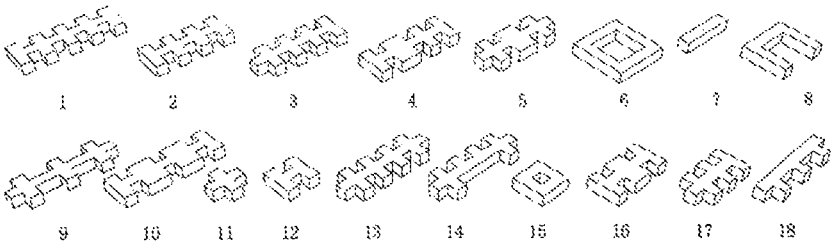
FIG. 13 is a schematic view of a portion A, a balcony of the house shown in FIG. 12.
Figure 13:
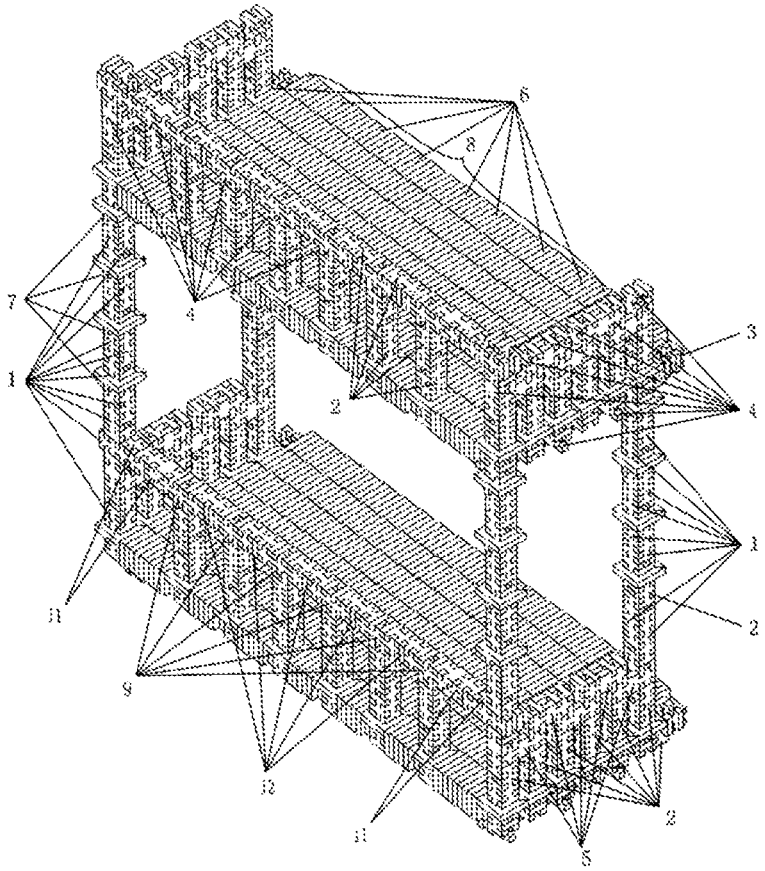
Figure 14:
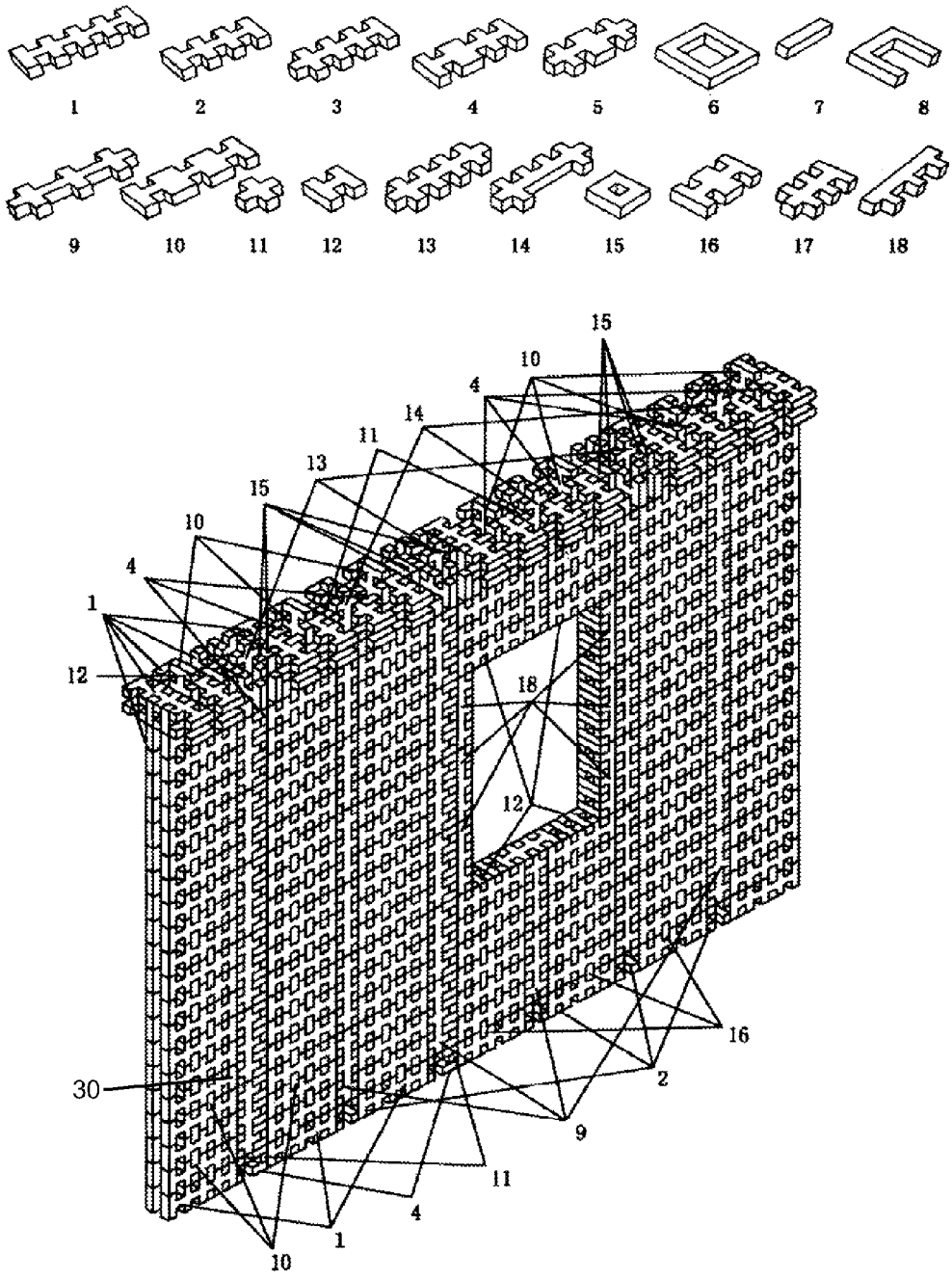
FIG. 14 is a schematic view of a portion B, a wall with a large window of the house shown in FIG. 12.
Figure 15:
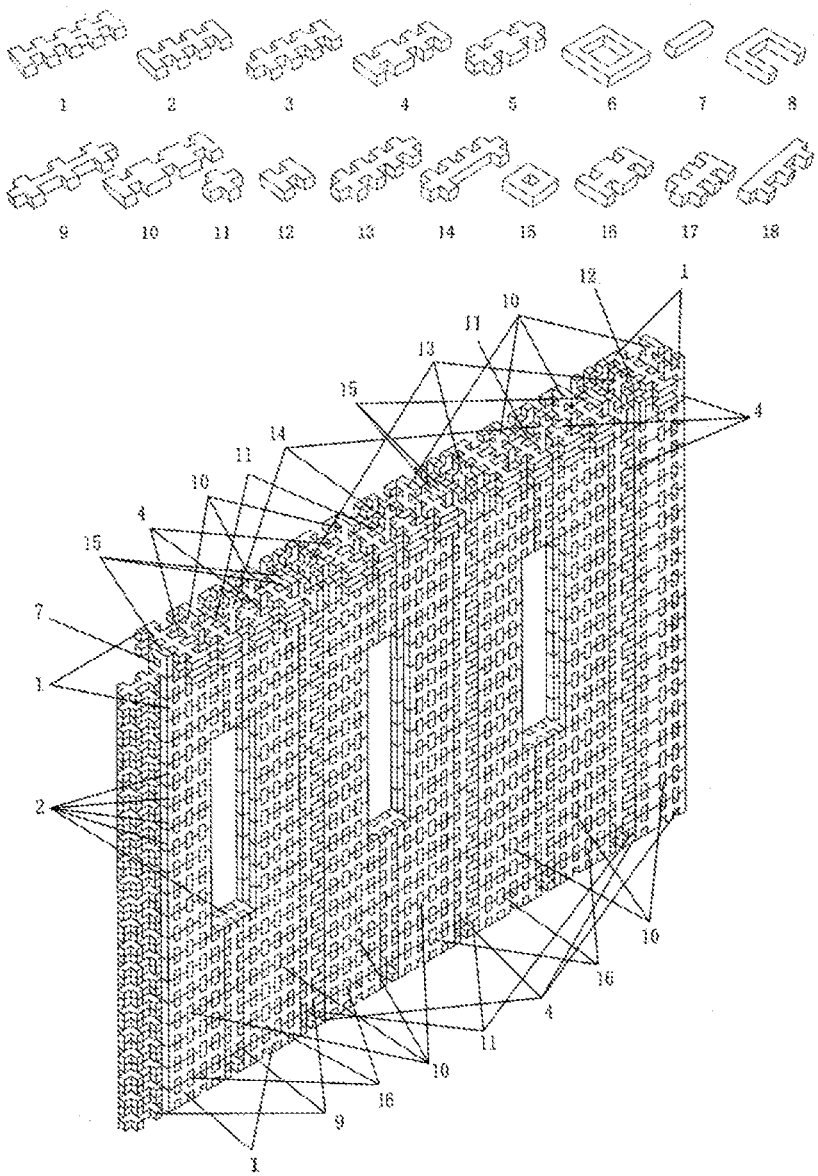
FIG. 15 is a schematic view of a portion C, a wall with a small window of the house shown in FIG. 12.

Referring to FIGS. 13 to 22, compared to the components used for manufacturing the pedestrian bridge, ten more kinds of components, such as components 9, 10, 11, 12, 13, 14, 15, 16, 17, and 18 shown in FIG. 13, are used in the structures shown from FIGS. 13 to 22. In the above components, the fish-bone shaped components 9 and 10 are used for stabilizing the wall of the house, the locking and assembling method of the wall is: locking one pair of component each of which has identical front and rear sides to another pair of component each of which has identical upper and lower sides to form a standing column 30 having a cross section composed of 3*3 cubes; the column then is placed horizontally to be extended according to the same method. After every three pairs of the components are locked together, concave spaces shaped as the Chinese character "十" or "工" are defined in upper/lower side or front/rear side of the three pairs of locked components. Three of the standing columns assembled according to the same method are placed horizontally as a top standing column, a middle standing column, and a lower standing column parallel to each other; a pair of fish-bone shaped components each of which has identical front and rear sides is locked to the concave spaces defined in the top standing column and the middle standing column placed in parallel; another pair of fish-bone components each of which has identical front and rear sides is locked to the concave spaces defined in the middle standing column and the lower standing column placed in parallel, thereby locking the top standing column, the middle standing column, and the lower standing column together. An extending portion of the wall can be assembled according to the same principle and method. Additionally, components 11, 12, 13, 14, 15, 16, 17, and 18 are located in the connecting portion between the upper floor and the lower floor or located in opening positions corresponding to the door or the window in the wall. Components 9, 10, 13, and 14 are used for locking the connecting portions, and components 11, 12, 15, 16, 17, and 18 are used for filling the wall or the door and the openings located between the window and the wall. The numbers of components 11, 12, 13, 14, 15, 16, 17, and 18 used in the embodiment are respectively low, and the components 11, 12, 14, 16, 17 and 18 can be manufactured by cutting components 1, 2, 3, 4, 5, 6, 7, 8, 9, and 10. Thus, the main components used for manufacturing the house are still components 1, 2, 3, 4, 5, 6, 7, 8, 9, and 10, among which most of the components are the same components used for manufacturing the pedestrian bridge shown in FIG. 5.

Figure 23:
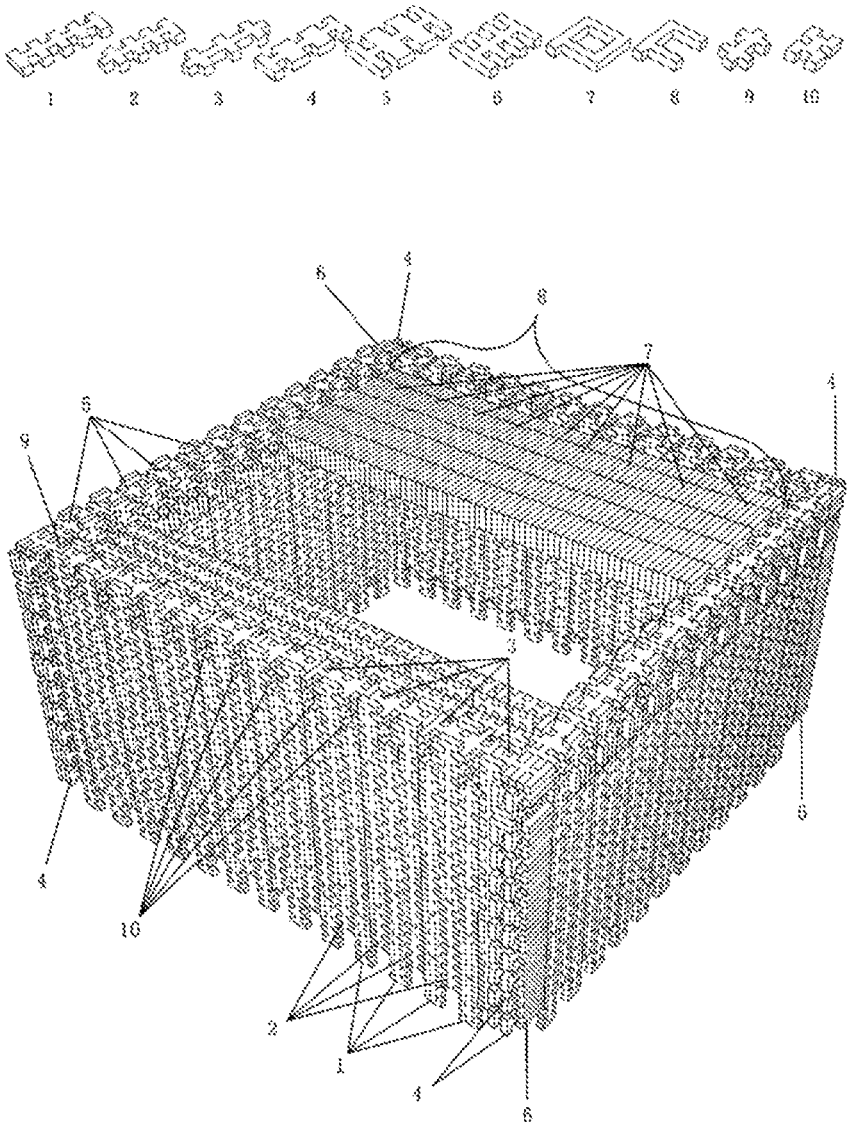
FIG. 23 is a schematic view of another wall and another floor built by the modular construction system and the components of the invention.

Referring to the model of the wall and the floor surface shown in FIG. 23, in the embodiment, another series of components of similar shapes, referring to the components 1, 2, 3, 4, 5, 6, 7, 8, 9, and 10 shown in FIG. 23, are used for manufacturing the house. The house manufactured by the series of components has a similar structure to that of the house in the above embodiment. It can be told from the drawing that shapes of the wall, floor beam, and floor of the house manufactured in the embodiment are respectively different from the shapes of the wall, the floor beam, and the floor of the house in the embodiment shown in FIG. 12. However, the locking way and principle of the structure of the house in the embodiment are the same as those of the house in the above embodiment shown in FIG. 12. This series of components can be used for manufacturing houses with thickening walls. With the thickness of each component designed to be 5 millimeters, the thickness of the wall shown in FIG. 23 can reach 25 millimeters. From the embodiment, under the teaching of the idea of the invention and the embodiments of the invention, those skilled in the art are capable of immaterially modifying the embodiments according to what is disclosed in the invention, principles, and common senses, for example, partly changing the shapes of the components, changing the way that the components are locked to each other, and so on. As the structure and the components shown in the embodiment shown in FIG. 23, modified embodiments of the same function and the same effect or embodiments similar to the above embodiments are within the scope of the invention.

Figure 24:
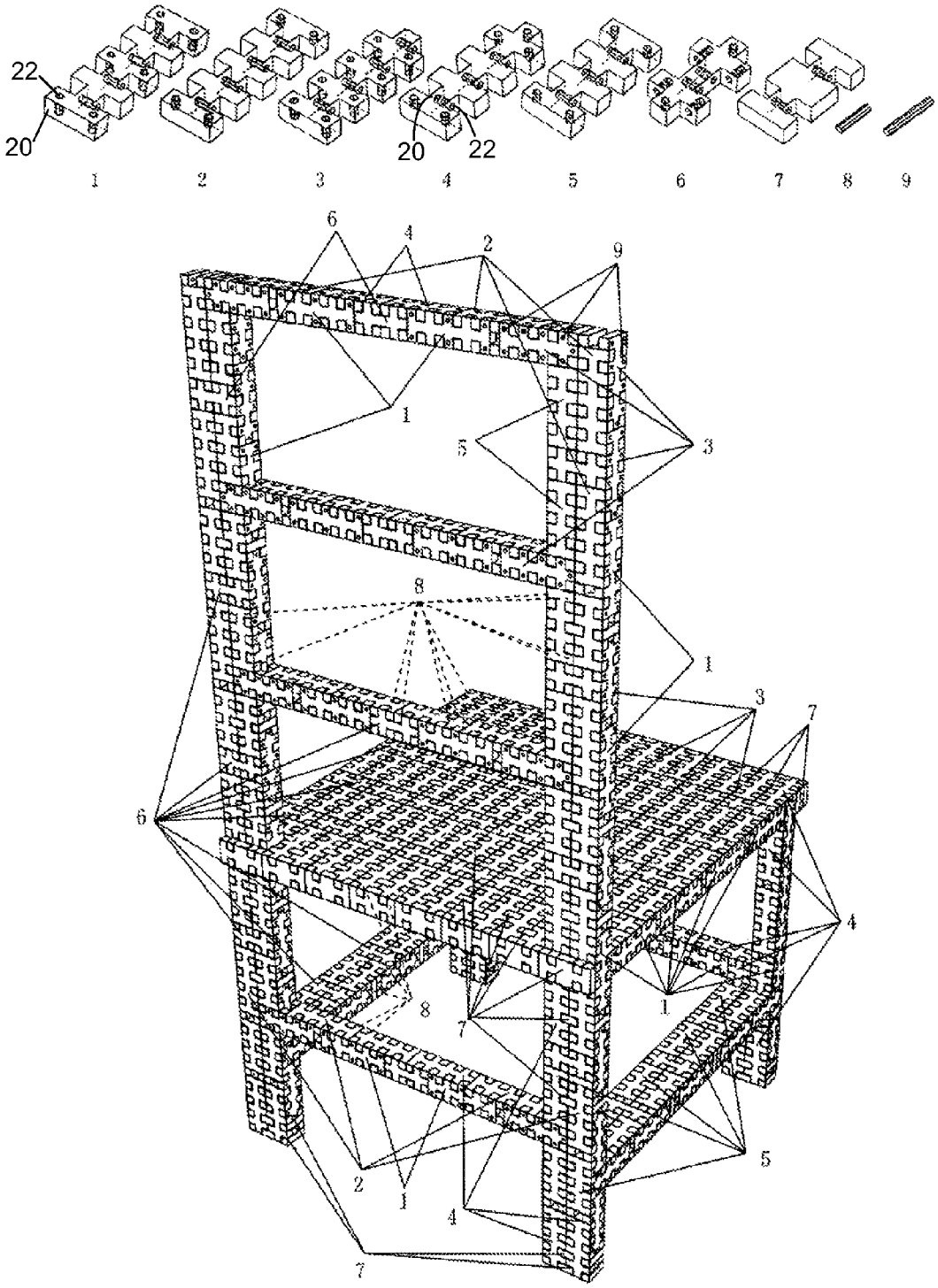
FIG. 24 is a schematic view of a chair, a piece of furniture manufactured by the modular construction system and the components with holes of the invention.

Referring to FIG. 24, which is a schematic view showing a chair manufactured by the modular construction system and the components, in accordance with an embodiment of applying the present invention in the field of furniture. The components forming the chair include components 1, 2, 3, 4, 5, 6, 7, 8, and 9. Components 1 to 7 are configured with holes and are locked to each other in some order with the "—" shaped pin components 8 and 9 inserted thereinto to form columns and planes of the chair. Dotted lines shown in FIG. 24 are referred to short pin component 8 which is enclosed inside when being locked to other components and referred to the positions of the short pin component. In the embodiment, the thickness of each component of the series of components is 1 millimeter, correspondingly, the chair has a total height of 101 millimeters and a seating height of 40 millimeters. In practical application of the invention, more components configured with holes can be used for manufacturing objects in the field of furniture to allow the objects to have aesthetic figures. At the same time, from the embodiment, under the teaching of the idea of the invention and the embodiments of the invention, those skilled in the art are capable of immaterially modifying the embodiments according to what is disclosed in the invention, principles, and common senses, for example, partly changing the shapes of the components, changing the arrangements and directions of the holes, and so on, to form planes and columns. Modified embodiments having the same functions or effects as those of the above embodiment or embodiments similar to the above embodiment are within the scope of the invention.

Even though information and the advantages of the present embodiments have been set forth in the foregoing description, together with details of the mechanisms and functions of the present embodiments, the disclosure is illustrative only; and that changes may be made in detail, especially in matters of shape, size, and arrangement of parts within the principles of the present embodiments to the full extend indicated by the broad general meaning of the terms in which the appended claims are expressed.

What is claimed is:

1. A modular construction system comprising:

at least one component in the shape of the Chinese character 口, at least one component in the shape of the Chinese character 一, at least one component in the shape of the Chinese character 冂, at least one pin component in the shape of the Chinese character 一, and a plurality of fish-bone shaped components, wherein the fish-bone shaped components are formed based on the shapes of the Chinese characters 工, 王, 十, 土, or 干;

wherein except the pin components, each component exhibits the shape of one or more Chinese characters, each component is formed by a plurality of identical cubes, at least one cube defines a hole therein to receive and engage the pin component, each component has a thickness of one cube, at least one component includes a cube shaped projection and at least another component includes a cube shaped recess, and the projection and the recess are configured to lock to each other to engage the two components to form a stable object;

wherein each component is configured to be an element of a disassembled plane or standing column;

wherein the component in the shape of the Chinese character 口 is configured to lock with the pin component to form a stable plane or standing column; and wherein at least one component has a material of high tensile strength.

2. The modular construction system of claim 1, wherein one fish-bone shaped component includes nineteen identical cubes, the fish-bone shaped component exhibits the shape of a combination of the Chinese character 王 and the Chinese character 土, the fish-bone shaped component has a thickness of one cube, and each cube of the fish-bone shaped component defines a hole therein configured to receive one pin component.

3. The modular construction system of claim 1, wherein one fish-bone shaped component includes fifteen identical cubes, the fish-bone shaped component exhibits the shape of a combination of the Chinese character 工 and the Chinese character 土, the fish-bone shaped component has a thickness of one cube, and each cube of the fish-bone shaped component defines a hole therein configured to receive one pin component.

4. The modular construction system of claim 1, wherein one fish-bone shaped component includes sixteen identical cubes, the fish-bone shaped component exhibits the shape of a combination of two Chinese character 土's, the fish-bone shaped component has a thickness of one cube, and each cube of the fish-bone shaped component defines a hole therein configured to receive one pin component.

5. The modular construction system of claim 1, wherein one fish-bone shaped component includes eighteen identical cubes, the fish-bone shaped component exhibits the shape of a combination of the Chinese character 王 and the Chinese character 工, the fish-bone shaped component has a thickness of one cube, and each cube of the fish-bone shaped component defines a hole therein configured to receive one pin component.

6. The modular construction system of claim 1, wherein one fish-bone shaped component includes sixteen identical cubes, the fish-bone shaped component exhibits the shape of a combination of the Chinese character 土 and the Chinese character 十, the fish-bone shaped component has a thickness of one cube, and each cube of the fish-bone shaped component defines a hole therein configured to receive one pin component.

7. The modular construction system of claim 1, wherein one component in the shape of the Chinese character 口 includes sixteen identical cubes arranged to form the shape of the Chinese character 口, and the component has a thickness of one cube.

8. The modular construction system of claim 1, wherein one component in the shape of the Chinese character 一 includes five identical cubes arranged to form the shape of the Chinese character 一, and the component has a thickness of one cube.

9. The modular construction system of claim 1, wherein one component in the shape of the Chinese character 冂 includes nine identical cubes arranged to form the shape of the Chinese character 冂, and the component has a thickness of one cube.

10. The modular construction system of claim 1, wherein one fish-bone shaped component includes fifteen identical cubes, the fish-bone shaped component exhibits the shape of a combination of three Chinese character 丨, the fish-bone shaped component has a thickness of one cube, and each cube of the fish-bone shaped component defines a hole therein configured to receive one pin component.

11. The modular construction system of claim 1, wherein one fish-bone shaped component includes twenty-one identical cubes, the fish-bone shaped component exhibits the shape of a combination of three Chinese character 工's, the fish-bone shaped component has a thickness of one cube, and each cube of the fish-bone shaped component defines a hole therein configured to receive onee pin component.

12. The modular construction system of claim 1, wherein one component in the shape of the Chinese character 十 includes seventeen identical cubes arranged to form the shape of the Chinese character, and the component has a thickness of one cube.

13. The modular construction system of claim 1, wherein one component in the shape of the Chinese character 工 includes fourteen identical cubes arranged to form the shape of the Chinese character 工, and the component has a thickness of one cube.

14. The modular construction system of claim 1, wherein one fish-bone shaped component includes thirty-three identical cubes, the fish-bone shaped component exhibits the shape of a combination of three Chinese character 工's, the fish-bone shaped component has a thickness of one cube, and each cube of the fish-bone shaped component defines a hole therein configured to receive one pin component.

15. The modular construction system of claim 1, wherein one fish-bone shaped component includes twenty-three identical cubes, the fish-bone shaped component exhibits the shape of a combination of the Chinese character 工 and the Chinese character 土, the fish-bone shaped component has a thickness of one cube, and each cube of the fish-bone shaped component defines a hole therein configured to receive one pin component.

16. The modular construction system of claim 1, wherein one component includes seventeen identical cubes arranged to form a shape based on the Chinese character 口 with one cube protruding from one lateral side thereof, and the component has a thickness of one cube.

17. The modular construction system of claim 1, wherein one component includes twelve identical cubes arranged to form a shape based on the Chinese character 冂 with one cube protruding from one lateral side thereof, and the component has a thickness of one cube.

18. The modular construction system of claim 1, wherein one fish-bone shaped component includes ten identical cubes, the component exhibits the shape of a combination of two Chinese character 工's, the fish-bone shaped component has a thickness of one cube, and each cube of the fish-bone shaped component defines a hole therein configured to receive one pin component.

19. The modular construction system of claim 1, wherein three pairs of the fish-bone shaped components are configured to form a standing column having a cross section of three by three cubes, two pairs of the components with identical front and rear sides are configured to lock to the third pair of the components with identical left and right sides to form the standing column, one component in the shape of the Chinese character 口 is configured to surround and lock the standing column, one component in the shape of the Chinese character 一 is configured to be inserted into at least one hole defined by the locked components to support and prevent the component in the shape of the Chinese character 口 from sliding downwards.

20. The modular construction system of claim 1, wherein two pairs of the fish-bone shaped components are configured to form a standing column having a cross section of three by three cubes, one pair of the components with identical front and rear sides is configured to lock to the other pair of the components with identical left and right sides, one component in the shape of the Chinese character 口 is configured to surround and lock the standing column, wherein the standing column is an assembly of a cross beam, one component in the shape of the Chinese character 口 is configured to lock to one side of the cross beam, and wherein a plurality of cross beams are configured to form a suspended plane structure.

21. The modular construction system of claim 1, wherein a pair of the components with identical front and rear sides is configured to lock to another pair of components with identical upper and lower sides to form a standing column having a cross section of three by three cubes; and wherein a first, second and third parallel standing column are configured to form a wall, a pair of fish-bone shaped components with identical front and rear sides is configured to lock the first and second standing column by engaging at least one recess defined by the standing columns, another pair of fish-bone shaped components with identical front and rear sides is configured to lock the second and third standing column by engaging at least one recess defined by the standing columns.

22. The modular construction system of claim 1, wherein two pairs of fish-bone components are configured to form a standing column having a cross section of three by three cubes, one pair of the fish-bone shaped components with identical front and rear sides is configured to lock to the other pair of the fish-bone shaped components, the pin component is configured to lock the two pairs of fish-bone shaped components by engaging at least one hole defined in the components.

23. The modular construction system of claim 1, wherein two pairs of fish-bone shaped components are configured to form a standing column, cubes located in each corner of one pair of the fish-bone shaped components with identical upper and lower sides define a hole perpendicular to a plane of the components, cubes located in a main part of the pair of fish-bone shaped components define a hole perpendicular to a plane of the components and parallel to the main part of the components, the cubes of the pair of fish-bone shaped components each having identical left and right sides, except the cubes located in the main part thereof, define a hole perpendicular to a plane of the components and parallel to the main part of the components;

wherein a short pin component is configured to be inserted into a hole defined in the main part of the pair of components having identical left and right sides, the short pin component is disposed to prevent the pair of components with identical left and right sides from moving forth and back;

wherein a long pin component is configured to be inserted into a hole defined in the pair of components having identical left and right sides, and the long pin component is disposed to prevent the pair of components with identical upper and lower sides from moving upwards and downwards;

wherein a plurality of standing columns are configured to be locked together, the standing columns are disposed parallel and adjacent to each other, a fish-bone shaped component exhibiting a shape that contains the Chinese character 十 or 工 is configured to lock adjacent standing columns by engaging a recess defined in the standing columns, wherein at least some cubes of the fish-bone shaped component define a hole parallel to a plane and main part of the component, the at least some cubes exhibit a shape that contains the Chinese character 十, and the at least some cubes are not located in the main part of the component, and wherein a long pin component is configured to be inserted into adjacent holes defined in the pair of components with identical left and right sides to prevent the components from moving downwards.

24. The modular construction system of claim 1, wherein a plurality of the components form a stable structure, a plane or a standing column of the stable structure.

25. The modular construction system of claim 1, wherein at least one cube defines a hole therein configured to receive the pin component, and wherein the pin component is configured to lock with one component in the shape of the Chinese character 口 to form a stable plane or standing column.

26. The modular construction system of claim 1, wherein the components are made of material of high tensile strength selected from the group consisting of metal, wooden, synthetic wooden, and plastic.

* * * * *